US010073397B2

(12) United States Patent
Nakase et al.

(10) Patent No.: US 10,073,397 B2
(45) Date of Patent: Sep. 11, 2018

(54) IMAGE FORMING APPARATUS AND CONTROL METHOD FOR UPDATING CONVERSION CONDITION CONVERTING MEASUREMENT RESULT OF MEASUREMENT UNIT

(71) Applicant: CANON KABUSHIKI KAISHA, Tokyo (JP)

(72) Inventors: Takahiro Nakase, Moriya (JP); Hayato Negishi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/492,790

(22) Filed: Apr. 20, 2017

(65) Prior Publication Data

US 2017/0308015 A1 Oct. 26, 2017

(30) Foreign Application Priority Data

Apr. 26, 2016 (JP) ..... 2016-087597
Feb. 9, 2017 (JP) ..... 2017-022467

(51) Int. Cl.
*G03G 15/00* (2006.01)
*G03G 15/16* (2006.01)

(52) U.S. Cl.
CPC ..... *G03G 15/5054* (2013.01); *G03G 15/1605* (2013.01)

(58) Field of Classification Search
CPC ..... G03G 15/1605; G03G 15/5054
See application file for complete search history.

(56) References Cited

U.S. PATENT DOCUMENTS 5,512,986 A * 4/1996 Toyomura ..... G03G 15/1605 358/448
5,697,012 A * 12/1997 Sasanuma ..... G03G 15/01 347/115
6,115,561 A 9/2000 Fukushima
6,148,158 A * 11/2000 Amemiya ..... G03G 15/01 358/519
6,243,542 B1 * 6/2001 Fujimoto ..... G03G 15/5062 399/49
6,418,281 B1 7/2002 Ohki
(Continued)

*Primary Examiner* — David Bolduc
(74) *Attorney, Agent, or Firm* — Canon U.S.A., Inc. IP Division

(57) ABSTRACT

An image forming apparatus including an image forming unit that forms an image, an intermediate transfer member for a measuring image, a measurement unit that measures the measuring image, a conversion unit that converts a measurement result of the measuring image on a basis of a conversion condition, a determination unit that determines an image forming condition on a basis of the converted measurement result, and an update unit that updates the conversion condition while forming and measuring first measuring images, converting the measurement results of the first measuring images, determining a measuring image forming condition on a basis of the converted measurement results, forming second measuring images on a basis of the measuring image forming condition, obtaining measuring results of the second measuring images output from another measuring unit, and updating the conversion condition on a basis of the measurement results of the second measuring images.

18 Claims, 23 Drawing Sheets

(56) References Cited

U.S. PATENT DOCUMENTS

2003/0128381 A1* 7/2003 Zaima ..... H04N 1/40025 358/1.9
2004/0131371 A1* 7/2004 Itagaki ..... G03G 15/5041 399/49
2005/0190386 A1* 9/2005 Zaima ..... H04N 1/4078 358/1.9
2007/0237531 A1* 10/2007 Maebashi ..... G03G 15/0126 399/49
2008/0131152 A1* 6/2008 Komiya ..... G03G 15/5062 399/49
2010/0021188 A1* 1/2010 Mizumukai ..... G03G 15/161 399/31
2010/0290799 A1* 11/2010 Komiya ..... G03G 15/5033 399/49
2010/0315685 A1* 12/2010 Zaima ..... G03G 15/5062 358/3.26
2011/0097096 A1* 4/2011 Sueoka ..... G03G 15/1605 399/49
2011/0109920 A1* 5/2011 Nakase ..... G03G 15/5008 358/1.5
2011/0304887 A1* 12/2011 Nakase ..... G03G 15/5033 358/3.24
2012/0019845 A1* 1/2012 Zaima ..... H04N 1/6033 358/1.9
2012/0020680 A1* 1/2012 Zaima ..... H04N 1/6033 399/15
2012/0033276 A1* 2/2012 Zaima ..... H04N 1/6033 358/518
2012/0207494 A1* 8/2012 Tomura ..... G03G 15/0189 399/40
2012/0294643 A1* 11/2012 Itagaki ..... G03G 15/0131 399/49
2012/0301163 A1* 11/2012 Hirata ..... G03G 15/0189 399/49
2012/0314227 A1* 12/2012 Zaima ..... G06K 15/027 358/1.2
2013/0016365 A1* 1/2013 Zaima ..... G03G 15/0173 358/1.2
2014/0255051 A1* 9/2014 Itagaki ..... G03G 15/5062 399/49
2015/0098095 A1* 4/2015 Zaima ..... H04N 1/6005 358/1.2
2015/0362868 A1* 12/2015 Sone ..... G03G 15/1615 399/49
2016/0041488 A1* 2/2016 Matsuoka ..... G03G 15/5062 399/15
2016/0085194 A1* 3/2016 Shirafuji ..... G03G 15/5025 399/49
2016/0216636 A1* 7/2016 Itagaki ..... G03G 15/04027
2016/0286091 A1* 9/2016 Negishi ..... G03G 15/01
2017/0090375 A1* 3/2017 Tanaka ..... G03G 15/5062
2017/0242382 A1* 8/2017 Zaima ..... G03G 15/5033

* cited by examiner

IMAGE FORMING APPARATUS AND CONTROL METHOD FOR UPDATING CONVERSION CONDITION CONVERTING MEASUREMENT RESULT OF MEASUREMENT UNIT

BACKGROUND

Field of Art

The disclosure relates to an image forming apparatus that forms an image on a sheet and a control method for the image forming apparatus.

Description of the Related Art

An image forming apparatus based on an electrophotographic method exposes a photosensitive member with light to form an electrostatic latent image, develops the electrostatic latent image on the photosensitive member, transfers an image on the photosensitive member to a sheet, heats up the sheet to which the image is transferred, and fixes the image on the sheet onto the sheet. The image forming apparatus controls an image forming condition such as an exposure light amount to control a density of the image fixed onto the sheet. However, even when the image forming condition is controlled to be set as a predetermined condition, the density of the output image is changed by a variation in a quantity of state such as a charge amount of developer, a sensitivity of the photosensitive member, or a transfer efficiency. In addition, in a case where an environment condition of the internal image forming apparatus or a surrounding environment condition of the image forming apparatus is changed, the density of the output image is changed.

In view of the above, the following techniques (calibrations) for maintaining a stability of an image quality have been proposed in the image forming apparatus. According to a first technique, the image forming apparatus forms a measuring image on a sheet, the measuring image on the sheet is read by a reader, and the image forming condition is determined on the basis of a reading result of the measuring image. However, according to the first technique, sheets are consumed, and the technique is not to be frequently executed. According to a second technique, a measuring image is formed on an image bearing member provided to the image forming apparatus, the measuring image is measured by an internal sensor, and the image forming condition is determined on the basis of a measurement result of the measuring image. However, a density of the measuring image formed on the image bearing member and a density of the measuring image fixed onto the sheet are slightly different from each other. For this reason, when only the second technique is adopted, the image forming condition is not determined at a high accuracy.

In view of the above, an image forming apparatus described in U.S. Pat. No. 6,418,281 uses the above-described two calibrations in combination and determines the image forming condition at a high accuracy on the basis of the measurement result of the measuring image on the image bearing member. The image forming apparatus described in U.S. Pat. No. 6,418,281 first forms a measuring image on a sheet, the measuring image is read by a reader, and the image forming condition is determined on the basis of a reading result of the measuring image by the reader. Next, a measuring image is formed on the image bearing member on the basis of the determined image forming condition, the measuring image on the image bearing member is measured by a sensor, and a measurement result of the sensor is stored as a target measurement result. Subsequently, a measuring image is formed on the image bearing member at a predetermined timing, the measuring image on the image bearing member is measured by the sensor, and the image forming condition is corrected on the basis of the measurement result of the sensor and the above-described stored target measurement result.

SUMMARY

An image forming apparatus according to an aspect of an embodiment includes an image forming unit configured to form an image on a sheet, an intermediate transfer member to which a measuring image formed by the image forming unit is transferred, a measurement unit configured to measure the measuring image on the intermediate transfer member, a conversion unit configured to convert a measurement result of the measuring image on a basis of a conversion condition, a determination unit configured to determine an image forming condition on a basis of the measurement result converted by the conversion unit, and an update unit configured to control the image forming unit to form first measuring images, control the measurement unit to measure the first measuring images, control the conversion unit to convert the measurement results of the first measuring images, control the determination unit to determine a measuring image forming condition on a basis of the converted measurement results of the first measuring images, control the image forming unit to form second measuring images on the sheet on a basis of the measuring image forming condition, obtain measuring results of the second measuring images output from another measuring unit different from the measurement unit, and update the conversion condition on a basis of the measurement results of the second measuring images, in which a number of the second measuring images is lower than a number of the first measuring images.

Further features will become apparent from the following description of exemplary embodiments with reference to the attached drawings.

DESCRIPTION OF THE EMBODIMENTS

Figure 2:
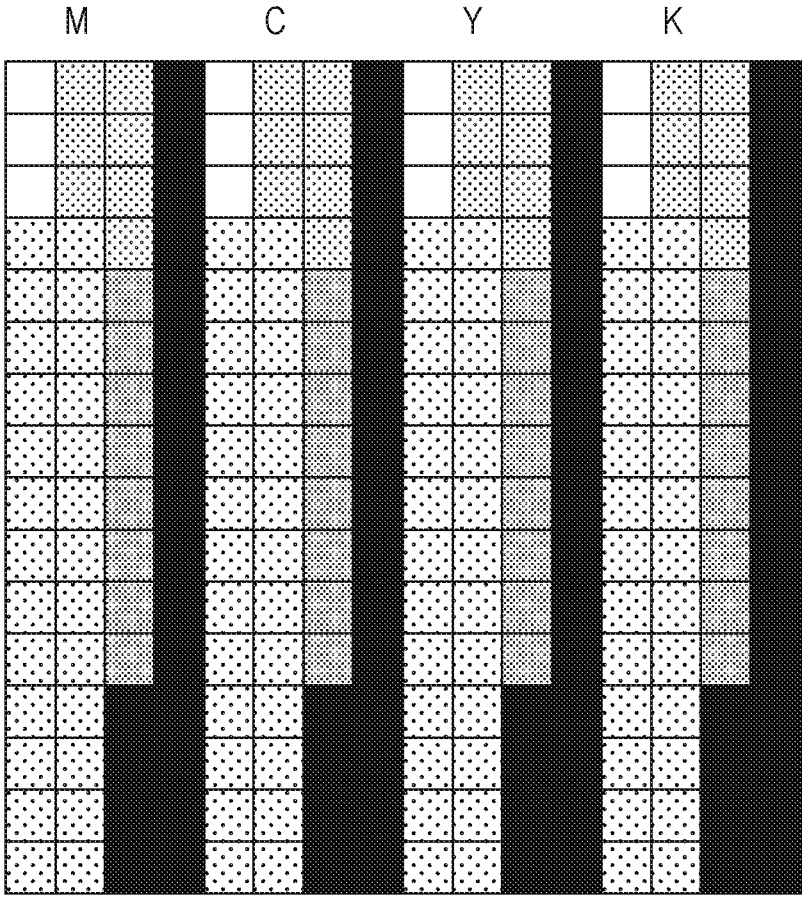
FIG. 2 is a schematic diagram of a measuring image formed on a sheet in tone correction control in related art.

A use number of sheets used for the calibration and a use amount of developer in the image forming apparatus described in U.S. Pat. No. 6,418,281 are high. The image forming apparatus described in U.S. Pat. No. 6,418,281 forms tone images in 64 levels for each color on a sheet as illustrated in FIG. 2, for example. A reason why the number of tones of measuring images is high is that tone characteristics are to be corrected at a high accuracy however the tone characteristics of the image forming apparatus are changed.

In addition, the recent image forming apparatus can execute a plurality of halftone processings. The halftone processings include, for example, dither processing for a high number of lines, dither processing for a low number of lines, and an error diffusion method. For this reason, in a case where the image forming apparatus executes the calibration corresponding to the plurality of halftone processings, the number of sheets used and the amount of developer used are further increased. In view of the above, an exemplary embodiment is aimed at suppressing the number of measuring images of the sheets used for the calibration.

Hereinafter, exemplary embodiments will be described in detail with reference to the drawings. It should be noted however that relative arrangements of components, numeric values, and the like described in the following exemplary embodiments are not intended to limit the scope of the present invention to only those described unless particularly specified.

First Exemplary Embodiment

Figure 3:
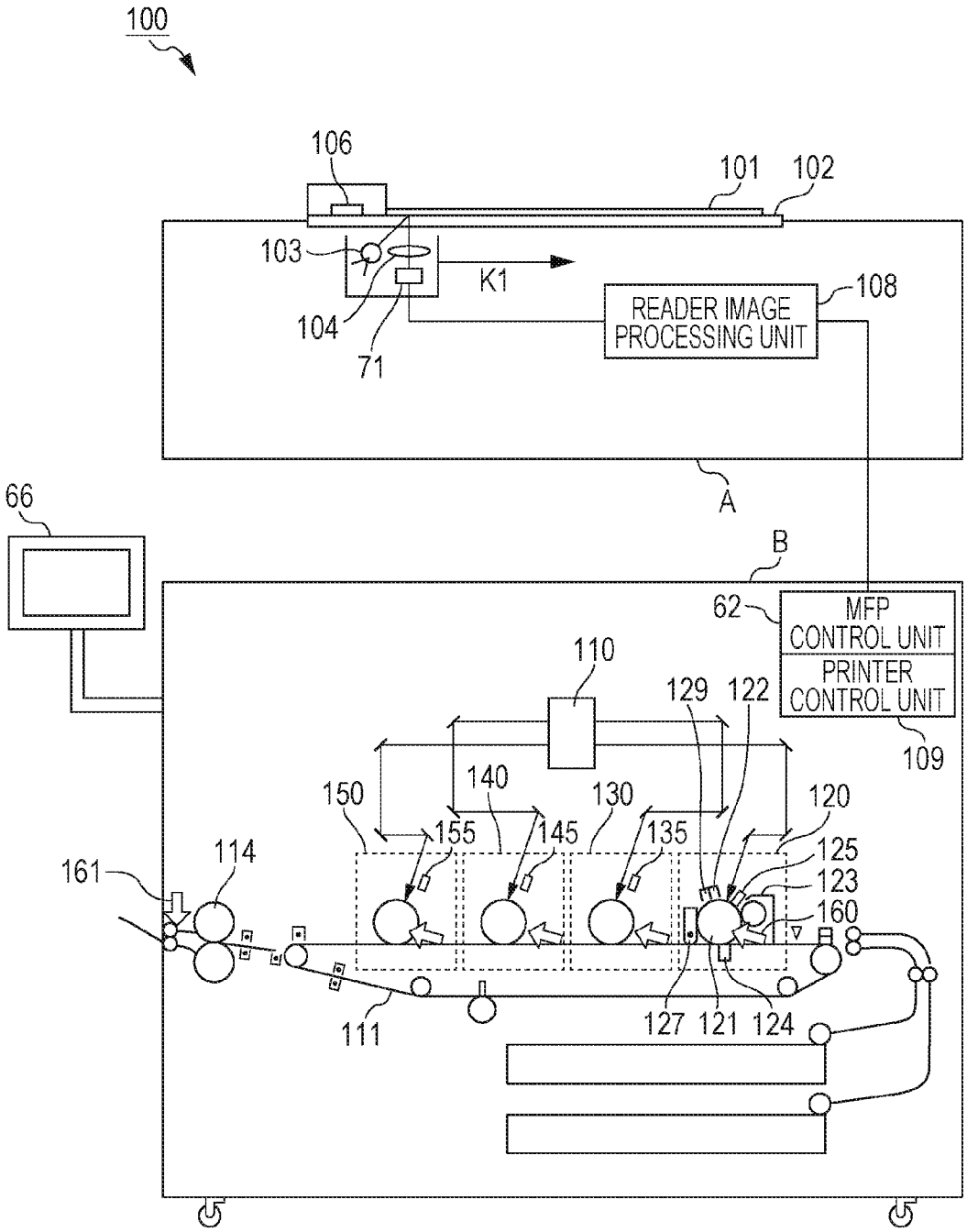
FIG. 3 is a schematic cross sectional view of an image forming apparatus.

FIG. 3 is a schematic cross sectional view of an image forming apparatus 100. The image forming apparatus 100 is provided with a reader A, a printer B configured to form an image on a sheet, and an operation unit 66.

The reader A is provided with an original platen glass 102, a light source 103, an optical system 104, a CCD sensor 71, and a white reference plate 106. The light source 103 irradiates an original 101 placed on the original platen glass 102 with light. Reflected light from the original forms an image on the CCD sensor 71 via the optical system 104. The light source 103, the optical system 104, and the CCD sensor 71 are contained in a carriage, and the carriage is moved in a direction of an arrow K1. As a result, the CCD sensor 71 reads an image of the original 101 for one page. That is, the reader A functions as a reading unit configured to read the original 101 placed on the original platen glass 102. The CCD sensor 71 transfers a reading result (electric signal) of the original 101 to a reader image processing unit 108. The reader image processing unit 108 generates an image signal on the basis of the reading result (electric signal). It should be noted that, to execute shading correction on the reading result of the reader A, the white reference plate 106 is read by the reader A. The shading correction is a related art technology, and a description thereof will be omitted. The reader A and or some subset of reader A such as the CCD sensor 71 may be configured as a measurement unit for measuring images.

The printer B is provided with image forming units 120, 130, 140, and 150, potential sensors 125, 135, 145, and 155, an exposure apparatus 110, a conveyance belt 111, and a fixing unit 114. The conveyance belt 111 is an example of an intermediate transfer member. The intermediate transfer member may be a member that transfers an image from an image forming unit onto a sheet.

The image forming unit 120 forms a cyan image, the image forming unit 130 forms a magenta image, the image forming unit 140 forms a yellow image, and the image forming unit 150 forms a black image. Configurations of the image forming units 120, 130, 140, and 150 are substantially the same. Hereinafter, the configuration of the image forming unit 120 configured to form the cyan image will be described. An image forming unit is configured to form an image that either directly or indirectly is formed on a sheet.

The image forming unit 120 is provided with a photosensitive drum 121, a charging unit 122, a developing unit 123, and a transfer unit 124. A photosensitive layer is formed on a surface of the photosensitive drum 121. A photosensitive drum functions a photosensitive member. The photosensitive drum 121 is rotated by a motor which is not illustrated in the drawing. The charging unit 122 uniformly charges the surface of the photosensitive drum 121. The exposure apparatus 110 exposes the photosensitive drum 121 charged by the charging unit 122 with light to form an electrostatic latent image. The developing unit 123 develops the electrostatic latent image on the photosensitive drum 121 to form an image. The transfer unit 124 transfers the image on the photosensitive drum 121 to the conveyance belt 111. The conveyance belt 111 conveys the sheet while bearing the sheet. At a timing when the image on the photosensitive drum 121 is conveyed to a nip portion between the photosensitive drum 121 and the conveyance belt 111, the sheet on the conveyance belt 111 is conveyed to the nip portion. As a result, the image on the photosensitive drum 121 is transferred to the sheet on the conveyance belt 111.

The image forming units 120, 130, 140, and 150 transfer the images to the sheet on the conveyance belt 111 such that the images of the respective colors are overlapped with one another. As a result, a full-color image is transferred to the sheet. Subsequently, the sheet is separated from the conveyance belt 111 and conveyed to the fixing unit 114. The fixing unit 114 is provided with a roller pair including a heater (not illustrated). The fixing unit 114 heats up the sheet by the roller pair and also applies a pressure to the sheet to fix the image onto the sheet. The sheet on which the image is fixed is discharged from the image forming apparatus 100 by a roller which is not illustrated in the drawing.

Furthermore, the potential sensor 125 measures a potential of the electrostatic latent image formed on the photosensitive drum 121. Similarly, the image forming units 130, 140, and 150 are respectively provided with the potential sensors (the potential sensors 135, 145, and 155).

The image forming unit 120 is further provided with a drum cleaner 127, a pre-exposure unit 129, and a photo sensor 160. The drum cleaner 127 removes toner (residual toner) remaining on the photosensitive drum 121 without being transferred to the sheet. The pre-exposure unit 129 irradiates the photosensitive drum 121 with light to remove electricity of the photosensitive drum. The photo sensor 160 is configured to detect a reflected light amount of a patch image formed on the photosensitive drum 121. The photo sensor 160 is provided with an LED 10 and a photodiode 11. It should be noted that the drum cleaner 127, the pre-exposure unit 129, and the photo sensor 160 are provided to each of the image forming units 130, 140, and 150. The photo sensor 160 for each image forming unit may be configured as a measuring unit for measuring images on each of the photosensitive drums.

Figure 4:
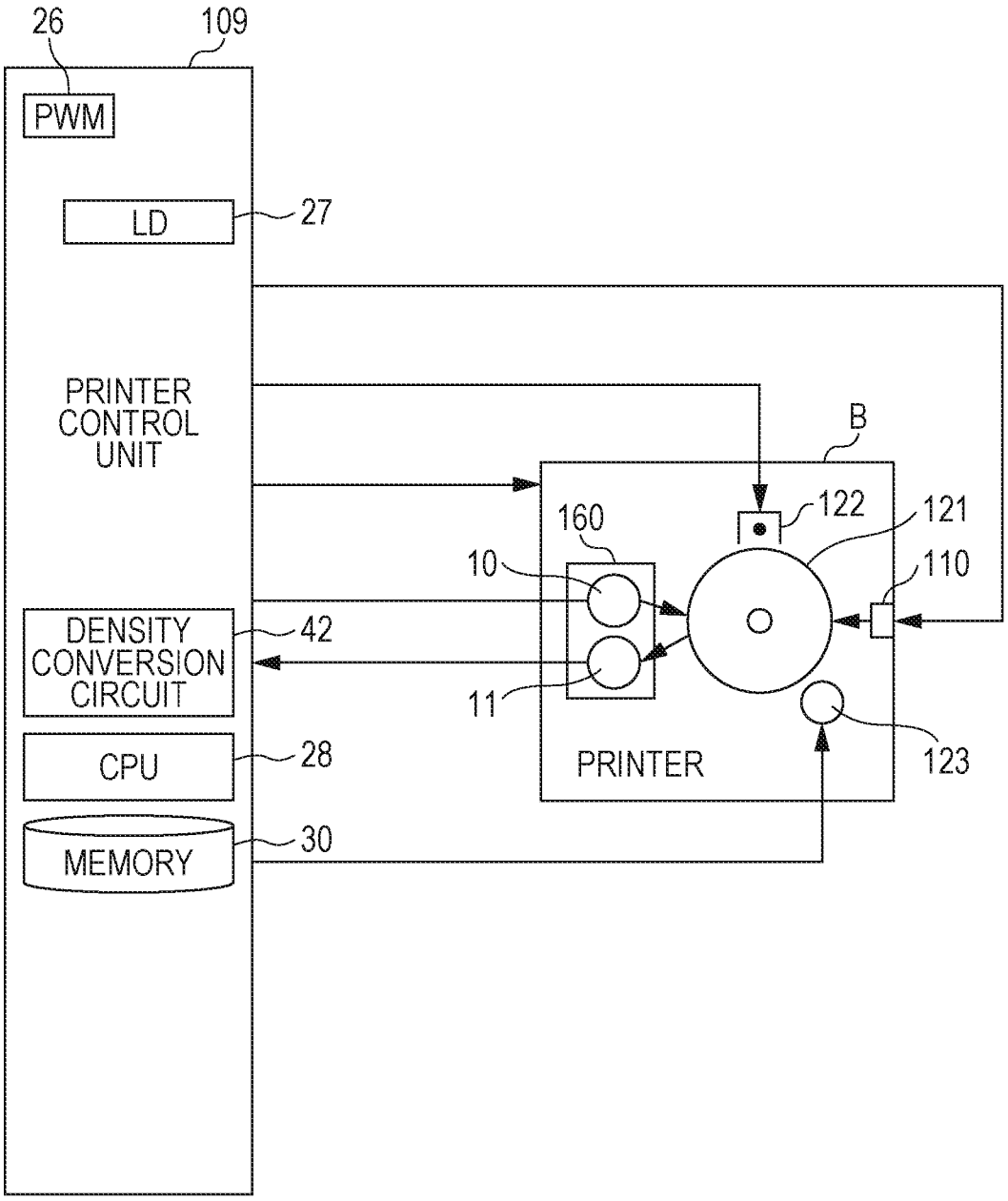
FIG. 4 is a control block diagram of a printer control unit.

Next, a printer control unit 109 configured to control the printer B will be described with reference to FIG. 4. The printer control unit 109 includes a CPU 28, a memory 30, and a density conversion circuit 42 and can communicate with the printer B. The printer control unit 109 controls the LED 10 of the photo sensor 160, the photodiode 11, the charging unit 122, and the developing unit 123. In addition, the printer control unit 109 is provided with a PWM circuit 26 configured to generate a laser output signal on the basis of a signal from an output image processing unit 64 (FIG. 5) and a laser driver (LD) 27 configured to control the exposure apparatus 110 on the basis of the laser output signal. The printer control unit 109 may be configured as an update unit to control other units within the image forming apparatus. The printer control unit 109 may be implemented as one or more circuits or as instructions encoded on a computer readable medium executed by one or more processors.

Figure 5:
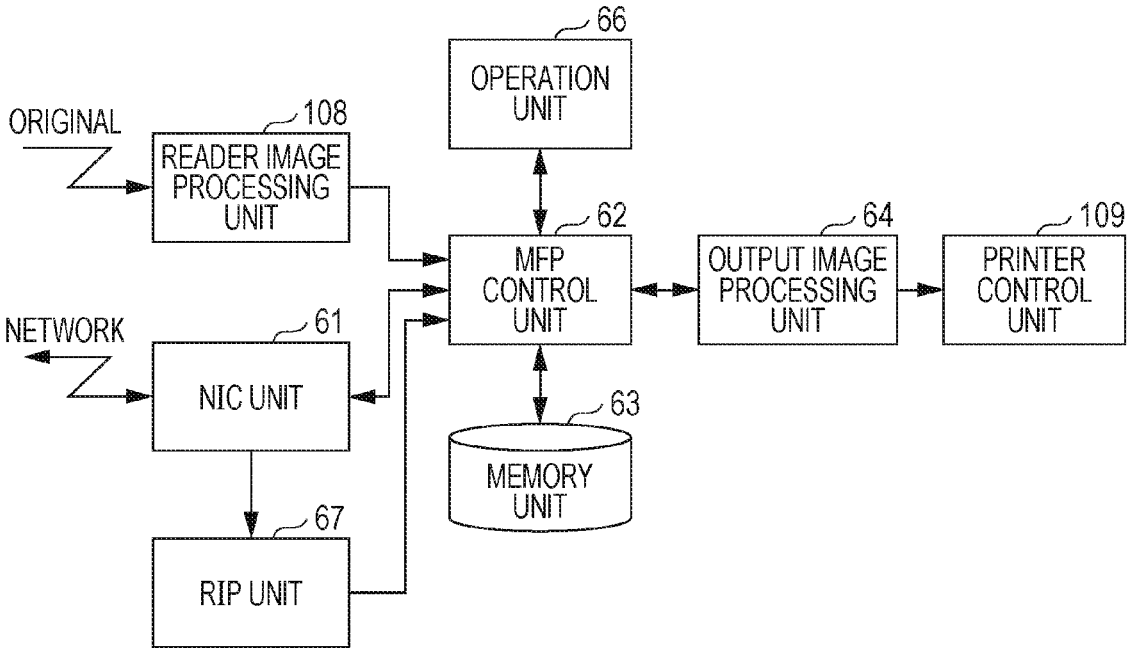
FIG. 5 is a control block diagram of the image forming apparatus.

FIG. 5 is a control block diagram of the image forming apparatus 100. The image forming apparatus 100 is provided with a network interface card (NIC) unit 61, a memory unit 63, the output image processing unit 64, and a raster image processor (RIP) unit 67. The memory unit 63 includes a ROM that stores a control program and a RAM functioning as a system work memory. The control program may be configured as an update unit. All or part of the memory unit 63 may be configured as a storage unit.

The reader image processing unit 108 executes the image processing on the image data on the basis of a reading result of the original 101 by the reader A. The image processing executed by the reader image processing unit 108 will be described below with reference to FIG. 6.

The NIC unit 61 supplies the image data (mainly, page description language (PDL) data) input via a network to the RIP unit 67 and transmits the image data obtained by the reader A and information of the image forming apparatus 100 via the network. The RIP unit 67 decodes the input PDL data to be developed into raster image data. The RIP unit 67 transmits the raster image data to an MFP control unit 62.

The MFP control unit 62 plays a role of traffic regulation for controlling the input data and the output data. The MFP control unit 62 is, for example, a processor. The image data input to the MFP control unit 62 is temporarily stored in the memory unit 63. The stored image data is read out when needed. The MFP control unit 62 may be configured as an update unit to control other units within the image forming apparatus. The MFP control unit 62 may be implemented as one or more circuits or as instructions encoded on a computer readable medium executed by one or more processors.

The output image processing unit 64 applies the image processing to the image data and transfers the image data to the printer control unit 109. The image processing executed by the output image processing unit 64 will be described below with reference to FIG. 7.

It should be noted that the printer B forms the image on the sheet on the basis of the image data output from the output image processing unit 64. The operation unit 66 is provided with buttons for inputting a printing setting, controlling the reader A to start a reading operation, and controlling the printer control unit 109 to execute the calibration of the image forming apparatus 100.

Next, the reader image processing unit 108 will be described.

Figure 6:
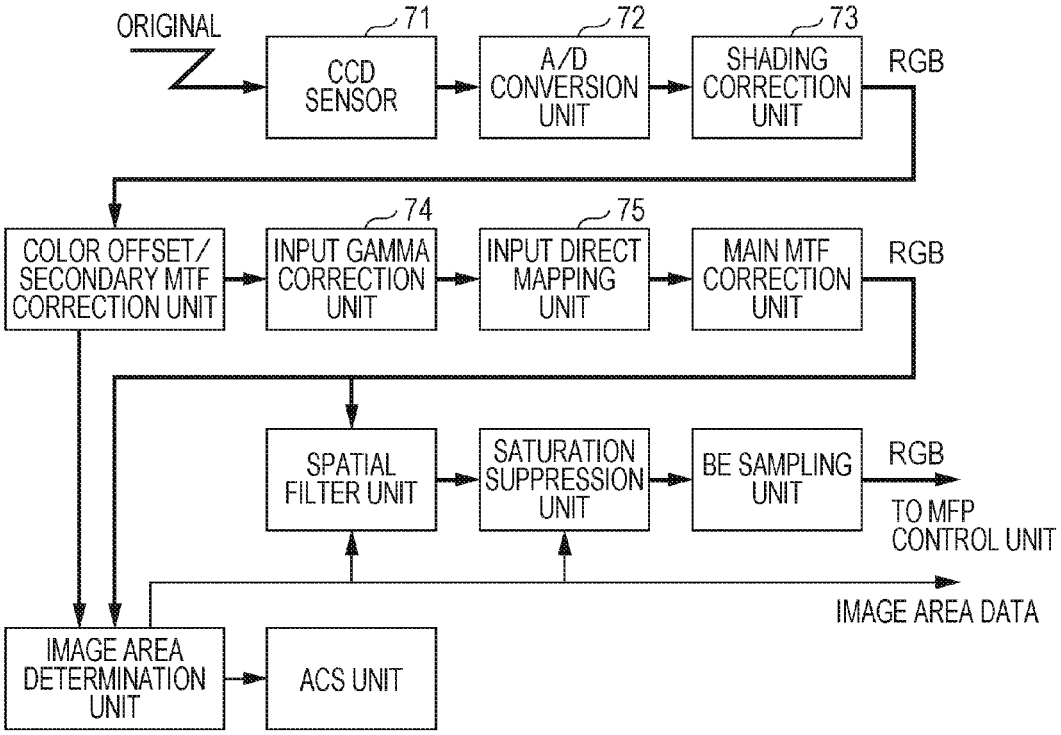
FIG. 6 is a function block diagram of a reader image processing unit.

FIG. 6 is a function block diagram of the reader image processing unit 108. The image read by the reader A is converted into an electric signal by the CCD sensor 71. The CCD sensor 71 is provided with a plurality of 3-line color sensors. The CCD sensor 71 is provided with pixels of red (R), green (G), and blue (B). The electric signal (analog value) output from each of the pixels is input to an analog-to-digital (A/D) conversion unit 72. In the A/D conversion unit 72, after amplification of the electric signal and offset adjustment of the electric signal are executed, the electric signal is converted into digital image data for each color signal.

A shading correction unit 73 corrects fluctuations in sensitivities of the respective pixels of the CCD sensor 71 fluctuations in a light amount of the light source 103 on the basis of the reading signal of the white reference plate 106. An input gamma correction unit 74 corrects the respective input values of red (R), green (G), and blue (B) such that an exposure amount and a luminance value have a linear relationship. Hereinafter, signals including the input values of red (R), green (G), and blue (B) will be referred to as RGB signals.

An input direct mapping unit 75 converts the RGB signals that depend on the input device (the reader A) into the RGB signals that do not rely on the device. The input direct mapping unit 75 converts a reading color space determined by spectral characteristics of RGB filters of the CCD sensor 71 into a standard color space. That is, the input direct mapping unit 75 converts the color space of the RGB signals into a color space appropriate to the image forming apparatus 100. The standard color space is, for example, a color space represented by using parameters of three stimulus values called sRGB. The input direct mapping unit 75 is provided with a function of absorbing various characteristics including sensitivity characteristics of the CCD sensor 71 and spectrum characteristics of the light source 103. Thereafter, several processings are executed on the image data. Subsequently, the image data is transmitted to the MFP control unit 62.

Figure 7:
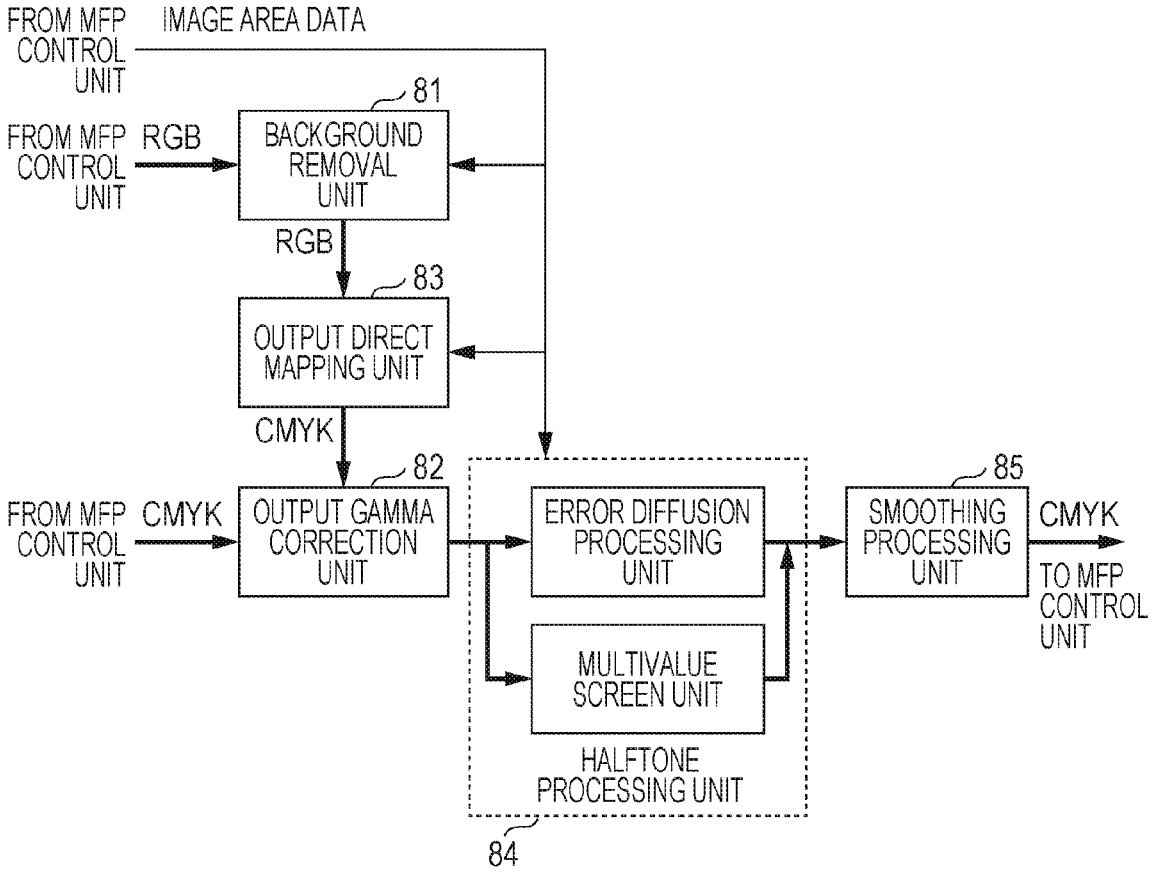
FIG. 7 is a function block diagram of an output image processing unit.

Next, the output image processing unit 64 will be described. FIG. 7 is a function block diagram of the output image processing unit 64. The image data input to the output image processing unit 64 includes the output data from the reader image processing unit 108 (RGB image data) and the output data from the RIP unit 67 (CMYK image data).

The RGB image data is input to a background removal unit 81. An output direct mapping unit 83 converts the RGB image data into the CMYK image data. The output direct mapping unit 83 generates an image signal value of cyan on the basis of a signal value of red (R), generates an image signal value of magenta on the basis of a signal value of green (G), and generates an image signal value of yellow on the basis of a signal value of blue (B). Furthermore, the output direct mapping unit 83 generates an image signal value of black on the basis of the signal value of green (G). The direct mapping unit 83 may generate the image signal values based on complementary colors or other methods. Subsequently, the CMYK image data output from the output direct mapping unit 83 is input to an output gamma correction unit 82 which will be described below. It should be noted that the CMYK image data is directly input to the output gamma correction unit 82 that will be described below. The output gamma correction unit 82 may be configured as all or part of a correction that corrects image data on the basis of tone correction condition such as that in one or more look up tables (e.g. γLUT). The output gamma correction unit 82 may implemented as one or more circuits or as instructions encoded on a non-transitory computer readable medium executed by one or more processors.

The output gamma correction unit 82 performs the density correction of the output image corresponding to the printer B. The output gamma correction unit 82 converts the image signal value (input value) into the image signal value (output value). The output gamma correction unit 82 converts the image signal value (input value) on the basis of a look-up table (γLUT). The look-up table (γLUT) is provided for each color. The γLUT corresponds to a tone correction condition for correcting tone characteristics of the output image.

A halftone processing unit 84 can execute various different types of the halftone processings. The halftone processing unit 84 executes the halftone processing appropriate to the output image on the image data.

In general, an error diffusion method with which moiré hardly occurs and a dither method with which reproducibility of characters and fine lines is high have been proposed as the halftone processing. The error diffusion method is a method of weighting a target pixel and its surrounding pixels by using an error filter and distributing errors of multiple-value process while the number of tones are maintained to perform the correction. On the other hand, the dither method is a method of setting a threshold of a dither matrix as multiple values and representing half tones in an artificial manner.

A smoothing processing unit 85 detects an edge part with respect to each of the image for each color component to be converted into a pattern for reproducing the edge of the image more smoothly. As a result, occurrence of shagginess in the edge of the image is suppressed.

Next, processing performed in the output gamma correction unit 82 of the output image processing unit 64 will be described.

Figure 8:
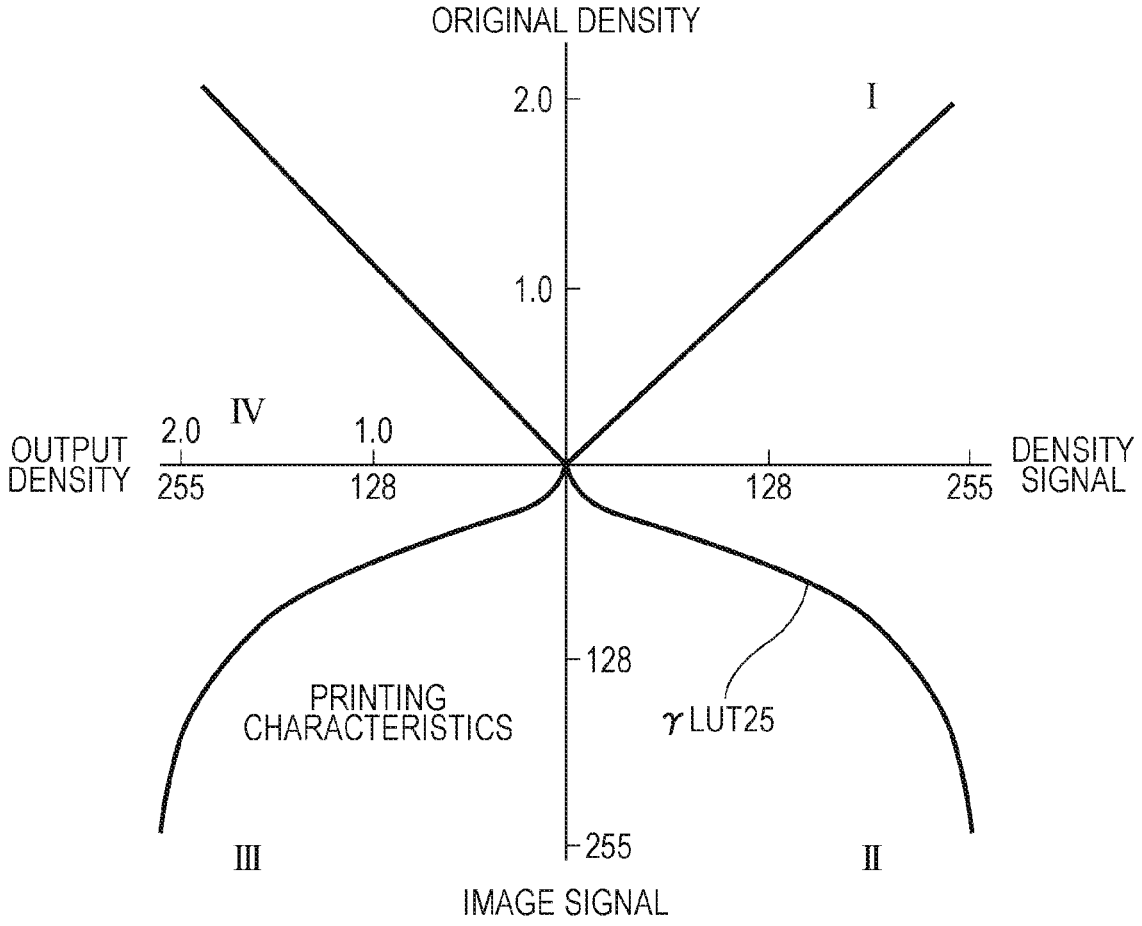
FIG. 8 is a quadrant chart.

FIG. 8 is a quadrant chart illustrating a state where tones are reproduced.

The first quadrant illustrates reading characteristics of the reader A indicating a correspondence relationship between the original densities (vertical axis) and the density signals (horizontal axis). The second quadrant illustrates conversion characteristics indicating a correspondence relationship between the density signals (horizontal axis) and the laser output signals (vertical axis). The third quadrant illustrates printing characteristics of the printer B indicating a correspondence relationship between the laser output signals (vertical axis) and the densities of the output images (horizontal axis). The fourth quadrant illustrates tone characteristics indicating a correspondence relationship between the original densities (vertical axis) and the densities of the output image (horizontal axis).

The output gamma correction unit 82 corrects the image signals on the basis of the γLUT such that the tone characteristics of the fourth quadrant are corrected to ideal tone characteristics. That is, the conversion characteristics of the second quadrant are equivalent to the γLUT. The γLUT is generated by a calculation result which will be described below. The output image processing unit 64 converts the image data on the basis of the γLUT, executes the halftone processing on the image data, executes smoothing processing on the image data, and transfers the image data to the printer control unit 109. The PWM circuit 26 converts the image signal values of the image data to signals corresponding to dot widths (laser output signals) and transfers the laser output signals to the LD 27. Thereafter, the LD 27 controls the exposure apparatus 110. As a result, the electrostatic latent image having predetermined tone characteristics is formed on the photosensitive drum 121 by changes in dot areas and macro area rates.

Hereinafter, tone correction control will be described in detail.

First, a control method in the related art will be described with reference to flow charts illustrated in FIGS. 9A to 9E.

Figure 9A:
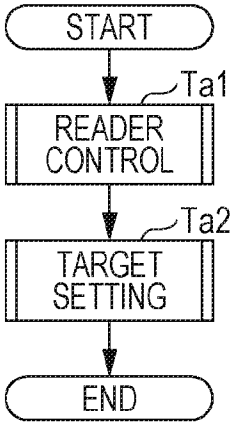
FIGS. 9A to 9E are flow charts illustrating the tone correction control in the related art.

The tone correction control in the related art includes reader control (Ta1) and target setting (Ta2) as illustrated in FIG. 9A.

Figure 9B:
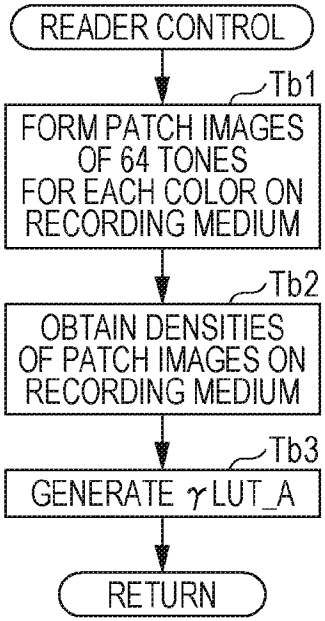

The reader control (Ta1) will be described with reference to FIG. 9B.

The image forming apparatus in the related art forms patch images of 64 tones for each color on the sheet (Tb1). In step Tb1, the γLUT generated in the tone correction control in the previous time is discarded. For this reason, initial values for returning input values to output values are set as values of the γLUT, for example. As a result, the densities of the patch images do not become the ideal densities like the printing characteristics of the printer B (the third quadrant of FIG. 8). Subsequently, when the sheet on which the patch images are formed is read by the reader, the image forming apparatus in the related art obtains the densities of the patch images on the basis of a reading result of the patch images by the reader (Tb2). Subsequently, the image forming apparatus in the related art generates a γLUT_A on the basis of the densities of the patch images and previously stored density targets (Tb3).

Figure 10A:
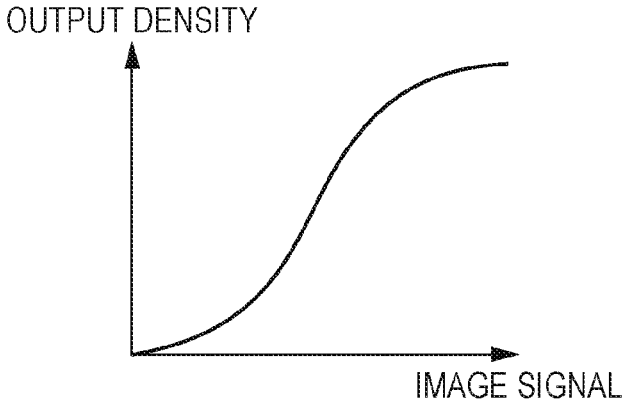
FIGS. 10A to 10C are schematic diagrams illustrating a calculation method for γLUT_A.
Figure 10B:
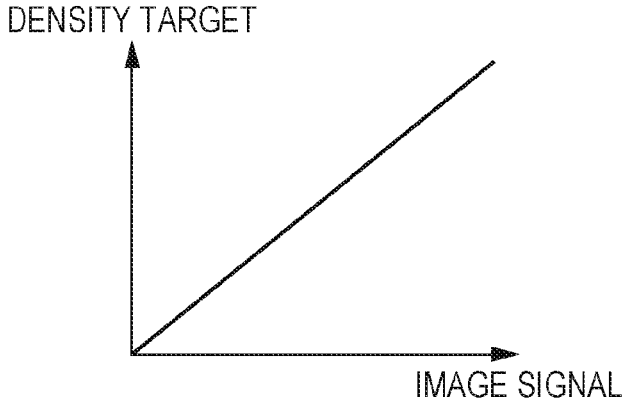
Figure 10C:
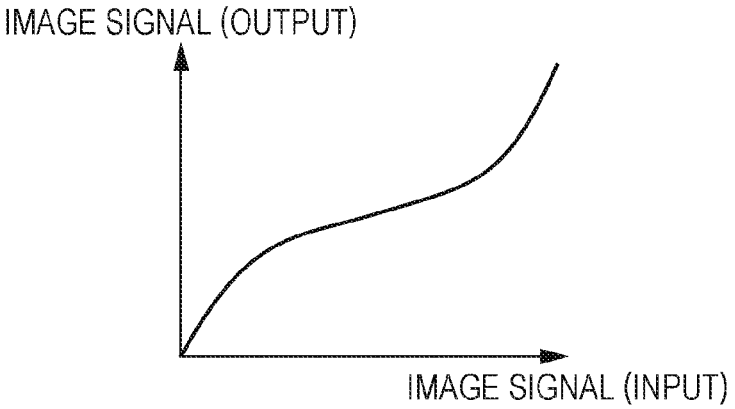

Here, a calculation method for the γLUT_A will be described with reference to FIGS. 10A to 10C. FIG. 10A illustrates the tone characteristics indicating a correspondence relationship between the image signals of the patch images (horizontal axis) and the density signals of the patch images (vertical axis). FIG. 10B illustrates the ideal tone characteristics indicating a correspondence relationship between the image signals (horizontal axis) and the density targets (vertical axis). FIG. 10C illustrates the γLUT_A for converting the image signals such that the tone characteristics are corrected to the ideal tone characteristics. The γLUT_A illustrated in FIG. 10C is generated by transposing coordinates of the input values of the image signals and the output densities. At this time, the densities of the input values where the patch images are not actually formed are predicted by interpolation calculation. However, since there is a possibility that the printing characteristics of the image forming apparatus in the related art may have a complex shape, the number of patch images formed on the sheet is not much reduced.

Figure 9C:
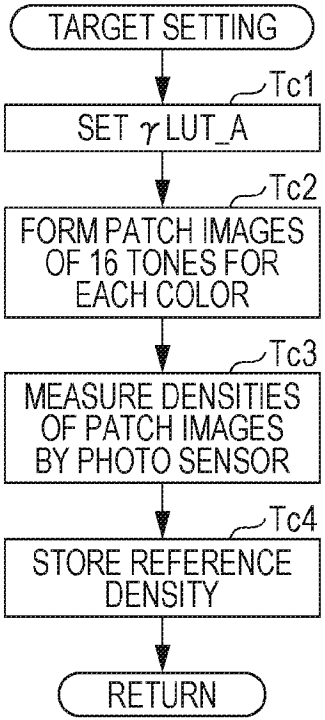

Next, the target setting (Ta2) will be described with reference to FIG. 9C.

The γLUT_A obtained in the above-described reader control (Ta1) is set by the image forming apparatus in the related art (Tc1). Next, the image forming apparatus in the related art converts the patch image data on the basis of the γLUT_A and forms the patch images of 16 tones for each color on the photosensitive drum (Tc2). The densities of the patch images on the photosensitive drum are detected by the photo sensor (Tc3).

In step Tc3, the output signals from the photo sensor are converted into the densities by using the density conversion circuit 42. It should be noted that the density conversion circuit 42 converts the output signal values from the photo sensor into the densities on the basis of the conversion table illustrated in FIG. 13B. The image forming apparatus in the related art stores the densities of the patch images obtained in step Tc3 as reference densities (Tc4).

Figure 9D:
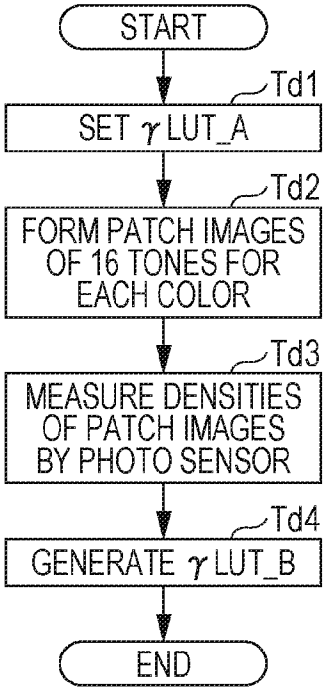

Next, the patch detection control that uses the photo sensor provided inside the image forming apparatus without using the sheet will be described with reference to FIG. 9D.

Since the patch detection control uses the photo sensor provided inside the image forming apparatus, an operation by the user to place the sheet on which the patch images are formed on the reader is not needed. For this reason, it is possible to automatically correct the tone characteristics without demanding a user's operation.

The γLUT_A obtained in the above-described reader control (Ta1) is set by the image forming apparatus in the related art (Td1). Next, the image forming apparatus in the related art converts the patch image data on the basis of the γLUT_A and forms the patch images of 16 tones for each color on the photosensitive drum (Td2). The patch images formed in step Td2 are the same as the patch images formed on the photosensitive drum in the target setting (step Tc2). The densities of the patch images on the photosensitive drum are detected by the photo sensor (Td3). Subsequently, the image forming apparatus in the related art corrects the γLUT_A on the basis of differences between the densities of the patch images and the reference densities set in step Tc4 to update the γLUT (Td4).

Figure 11A:
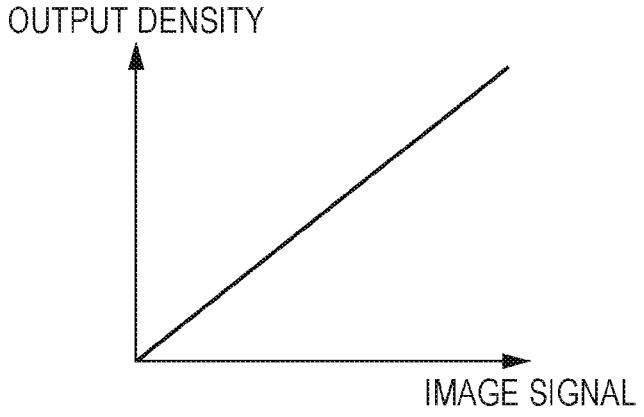
FIGS. 11A to 11C are schematic diagrams illustrating an update method for γLUT.
Figure 11B:
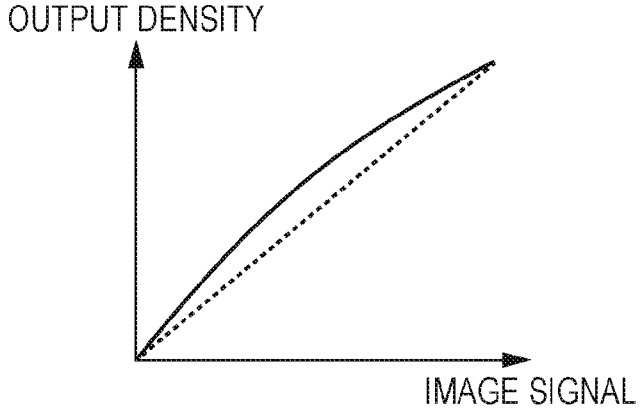
Figure 11C:
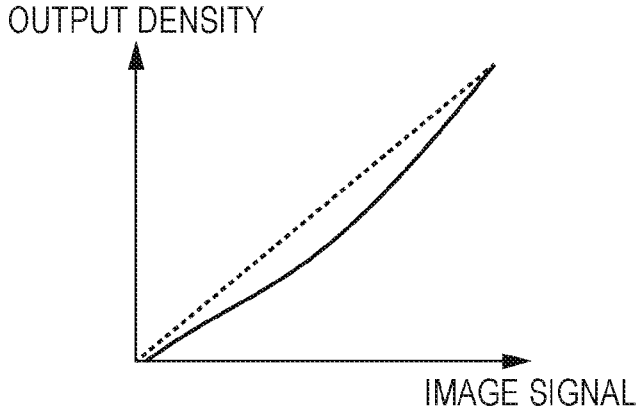

Here, an update method for the γLUT will be described. FIG. 11A illustrates the ideal tone characteristics. With regard to the ideal tone characteristics, for example, the relationship between the image signals and the densities is in directly proportion. However, in a case where the quantity of state of the image forming apparatus is changed, as illustrated in FIG. 11B, distortion is generated in the tone characteristics. In view of the above, the image forming apparatus amends the tone characteristics into the ideal density characteristics on the basis of a γLUT_B as illustrated in FIG. 11C. The γLUT_B is generated on the basis of the densities of the patch images measured by the photo sensor and the reference densities obtained in step Tc4.

Figure 9E:
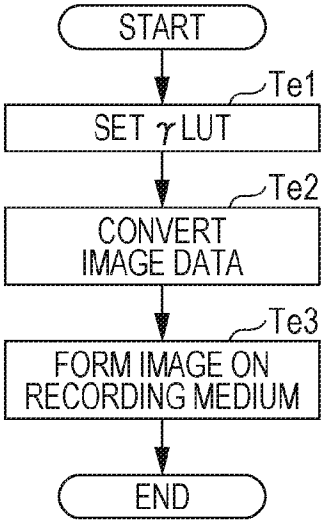

Next, image forming processing for the image forming apparatus to form the output image on the sheet on the basis of the image data will be described with reference to a flow chart of FIG. 9E. It should be noted that the image forming processing is similarly performed in the image forming apparatus in the related art and the image forming apparatus according to the present exemplary embodiment 100.

The image forming apparatus in the related art combines the γLUT_A and the γLUT_B with each other to set the γLUT (Te1). Subsequently, the image data is converted on the basis of the combined γLUT (Te2), and the output image is formed on the sheet on the basis of the converted image data (Te3).

Figure 12A:
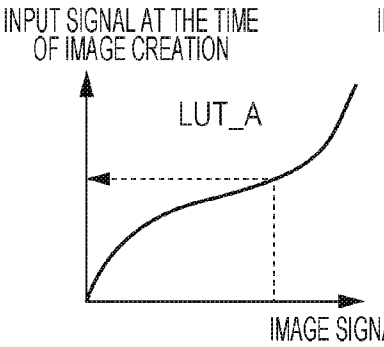
FIGS. 12A to 12H are schematic diagrams illustrating a state where an image signal is converted.
Figure 12B:
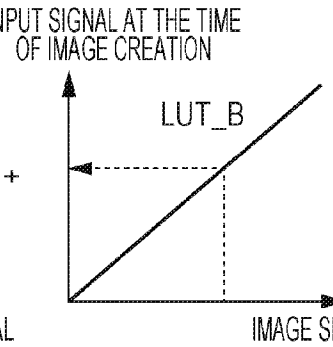
Figure 12C:
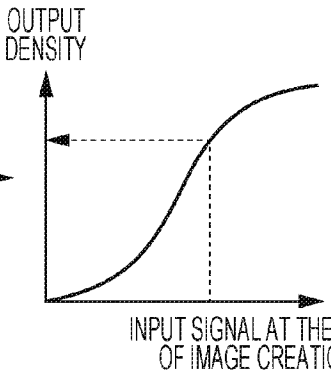
Figure 12D:
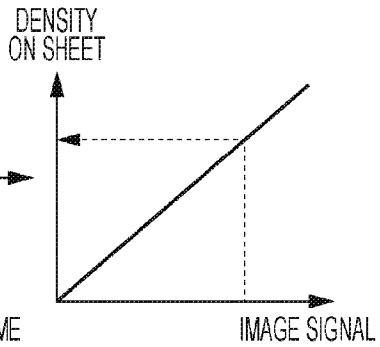
Figure 12E:
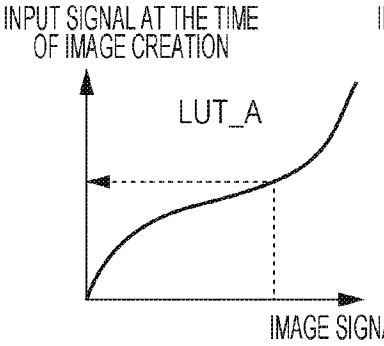
Figure 12F:
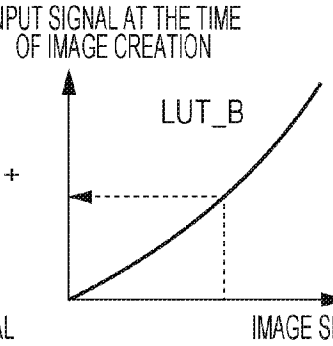
Figure 12G:
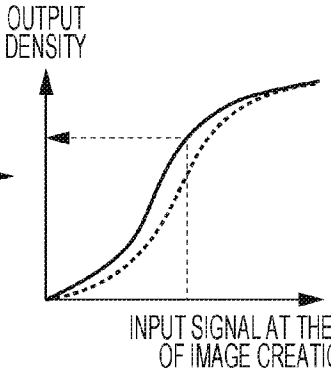
Figure 12H:
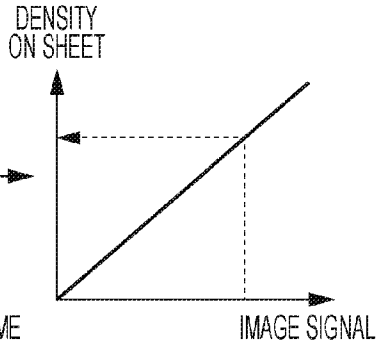

FIGS. 12A to 12H are schematic diagrams illustrating a state where the image signals are converted on the basis of the γLUT_A and the γLUT_B. FIGS. 12A to 12D illustrate a state where the image signals are converted before the patch control is executed, and FIGS. 12E to 12H illustrate a state where the image signals are converted after the patch control is executed to update the γLUT_B. When the image signal is converted on the basis of the γLUT_A illustrated in FIG. 12A and the γLUT_B illustrated in FIG. 12B as illustrated in FIG. 12C, the density of the image becomes target density. It should be noted that, since the γLUT_B is linear immediately after the reader control is executed, the image signal is substantially converted on the basis of only the γLUT_A. Even in a case where the printing characteristics are changed from a solid line of FIG. 12G to a broken line, when the patch detection control is executed, the image signal is changed on the basis of the γLUT_A and the γLUT_B. As a result, the density of the output image becomes the target density.

Hereinafter, different parts of the tone correction control of the image forming apparatus 100 from the related art example will be mainly described.

FIGS. 1A to 1D are flow charts illustrating the tone correction control of the image forming apparatus 100.

In response to an input of a command for instructing the execution of the tone correction control from the operation unit 66 by the user, the CPU 28 executes the tone correction control illustrated in FIGS. 1A to 1D. It should be noted that the respective steps of the tone correction control illustrated in FIGS. 1A to 1D are realized while the MFP control unit 62 executes a tone correction control program stored in the memory unit 63.

Figure 1A:
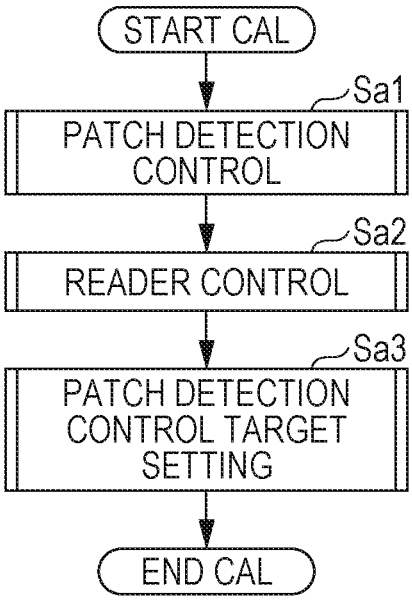
FIGS. 1A to 1D are flow charts illustrating tone correction control.
Figure 1B:
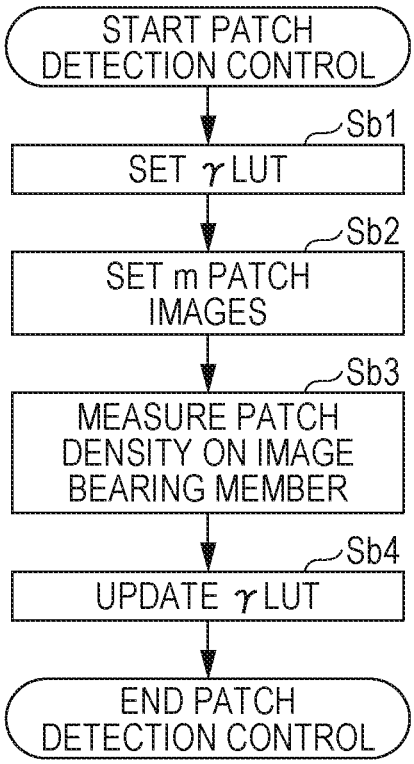

The tone correction control includes the patch detection control (Sa1), the reader control (Sa2), and the target setting (Sa3) as illustrated in FIG. 1A. Hereinafter, the patch detection control (Sa1) will be described with reference to FIG. 1B.

First, the MFP control unit 62 sets the latest γLUT stored in the memory unit 63 in the output gamma correction unit 82 (Sb1). Next, the MFP control unit 62 sets the patch image data 16 stored in the memory unit 63 in the output image processing unit 64 (Sb2). The output image processing unit 64 converts the patch image data 16 on the basis of the γLUT and transfers the patch image data 16 after the conversion to the printer control unit 109. The printer control unit 109 controls the printer B to form the patch images of 16 tones on each of the photosensitive drums. Subsequently, the printer control unit 109 detects the patch images by the photo sensor 160 (Sb3). In step Sb3, the CPU 28 stores the output values of the respective patch images by the photo sensor 160 in the memory 30. The memory 30 may be configured as a storage unit.

The density conversion circuit 42 converts the signal values output from the photo sensor 160 into the density signals (density data) on the basis of the conversion table. The conversion table is equivalent to a conversion condition used for converting the measurement result of the measuring image. In addition, the conversion table is not limited to data indicating the correspondence relationship between the output values and the densities. The density conversion circuit 42 may be, for example, a calculation circuit configured to output the values of the densities (density data) on the basis of the output values by using a calculation expression. The γLUT is generated on the basis of the thus obtained density signals and the previously set density targets (target density data) (Sb4). The density conversion circuit 42 may be configured as a conversion unit configured to convert a measurement result of the measuring image on a basis of a conversion condition. The density conversion circuit 42 may be implemented as a set of circuits, or as one or more processors (CPU) which implement instructions encoded on a non-transitory computer readable medium. The conversion unit may also include other circuits and/or instructions described above and below which are used in addition to or instead of the density conversion circuit 42 which are configured to convert measurement results.

Next, the reader control (Sa2) will be described with reference to FIG. 1C.

Figure 1C:
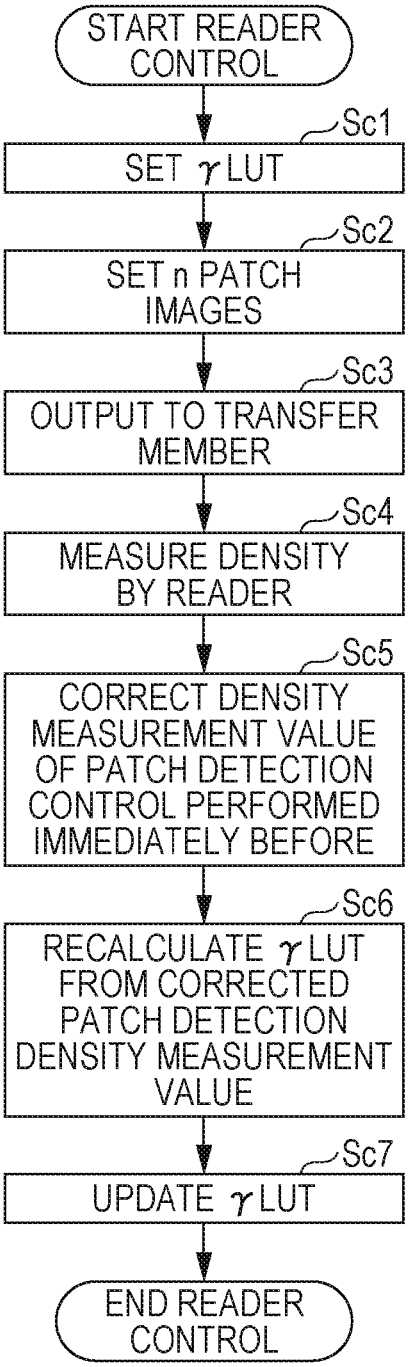

The MFP control unit 62 sets the γLUT generated in the patch detection control illustrated in FIG. 1C in the output gamma correction unit (Sc1). Next, the MFP control unit 62 sets patch image data 8 stored in the memory unit 63 in the output image processing unit 64 (Sc2). The output image processing unit 64 converts the patch image data 8 on the basis of the γLUT and transfers the converted patch image data 8 to the printer control unit 109. The printer control unit 109 controls the printer B to form the patch images of 8 tones for each color on the sheet (Sc3).

At this time, the densities of the patch images formed on the sheet by using the patch image data converted on the basis of the γLUT are more likely to have smaller differences with respect to the target densities than the densities of the patch images formed on the sheet by using the patch image data that is not converted by the γLUT are. Furthermore, since the differences between the target densities and the densities of the patch images are reduced in a broad range from a low density to a high density, even when the number of types of the densities of the patch images (tones) formed on the sheet is decreased, the correction accuracy is unlikely to be significantly decreased. That is, when the image forming apparatus 100 forms the patch images on the sheet by using the patch image data converted on the basis of the γLUT, it is possible to suppress the number of the patch images. The number of the patch images is set, for example, as 8 tones for each color. When the patch images on the sheet are read by the reader A, the MFP control unit 62 obtains density values of the patch images (Sc4). Subsequently, the MFP control unit 62 updates the conversion table on the basis of the density values of the patch images obtained in step Sc4 (Sc5). The MFP control unit 62 may be configured as a determination unit that determines an image forming condition on a basis of the measurement result and then updates the conversion table. The MFP control unit 62 may be implemented as one or more dedicated circuits or may be implemented as instructions encoded on a computer readable medium executed by one or more processors (CPU).

Figure 13A:
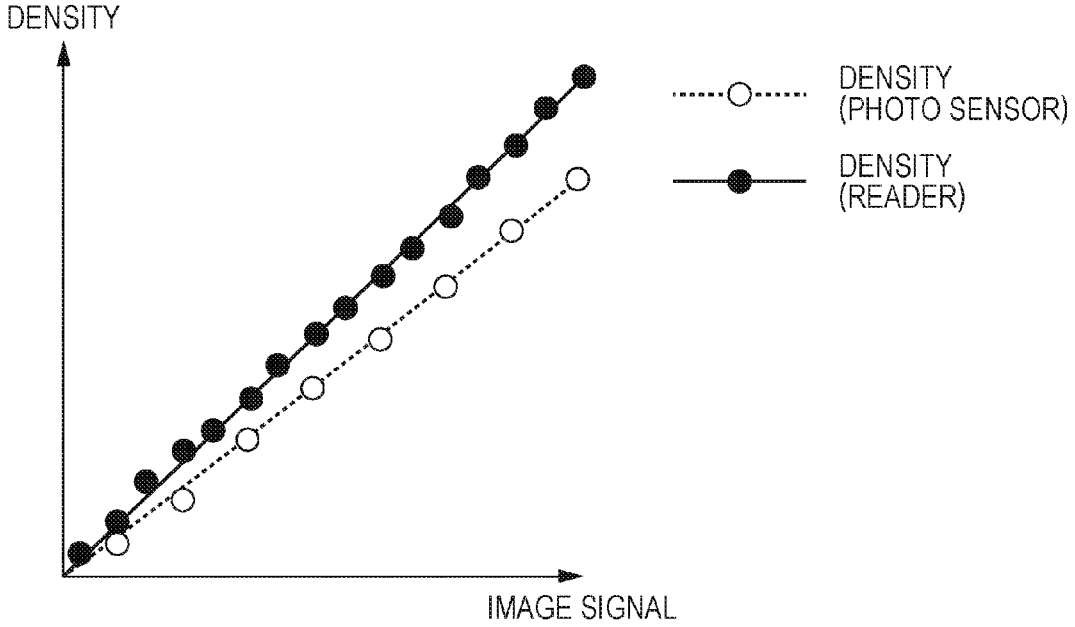
FIGS. 13A and 13B are comparative diagrams for a measurement value of a reader and a measurement value of a photo sensor.
Figure 13B:
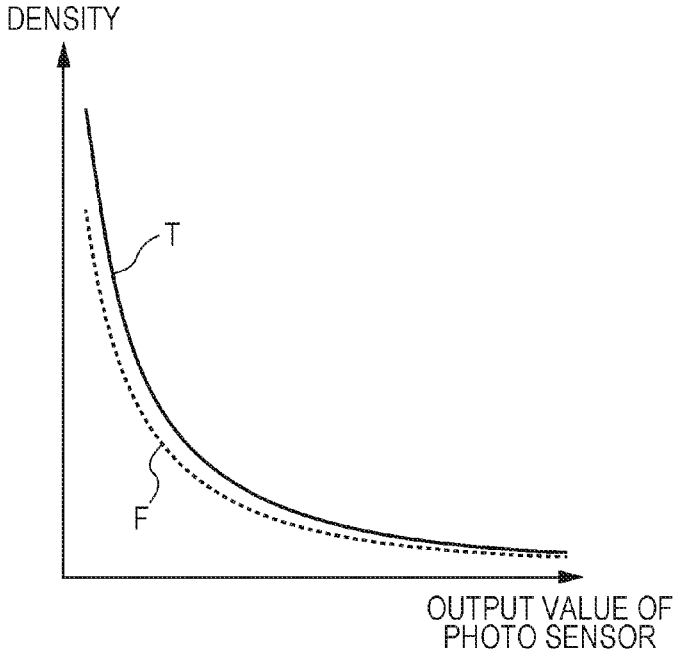

The update method for the conversion table will be described below. FIG. 13A is a comparison diagram between the densities of the patch images detected by the reader A and the densities of the patch images detected by the photo sensor 160. In FIG. 13A, the densities of the patch images detected by the photo sensor 160 are densities converted by the density conversion circuit 42 on the basis of the conversion table from the output values of the photo sensor 160. FIG. 13B is a schematic diagram illustrating the conversion table of the density conversion circuit 42. In FIG. 13B, a broken line F indicates the conversion table before the update, and a solid line T indicates a table 2 after the update.

First, the MFP control unit 62 obtains the corresponding relationship between the image signals and the densities (solid line) on the basis of the densities of the patch images obtained by the reader A and the patch image data 16 as illustrated in FIG. 13A. Similarly, the MFP control unit 62 obtains the corresponding relationship between the image signals and the densities (broken line) on the basis of the densities of the patch images obtained by the photo sensor 160 and the patch image data 8. Subsequently, the MFP control unit 62 corrects the table 2 (the broken line F) illustrated in FIG. 13B such that the corresponding relationship between the image signals and the densities (broken line) becomes the corresponding relationship between the image signals and the densities (solid line). The MFP control unit 62 offsets, for example, the output values of the photo sensor 160 to update the table 2 (the broken line F). The offset amount may be calculated, for example, by a least square method.

The descriptions will be given of the reader control illustrated in FIG. 1C again. The MFP control unit 62 converts the output values of the photo sensor 160 stored in the memory 30 into the densities on the basis of the updated table 2 to generate the γLUT again (Sc6). In step Sc6, the output values of 16 tones stored in the memory 30 in step Sb3 are converted by the density conversion circuit 42 into the densities on the basis of the table 2 after the update. Subsequently, in step Sc6, the MFP control unit 62 generates the γLUT on the basis of the densities after the conversion such that the tone characteristics become the ideal tone characteristics. The MFP control unit 62 updates the γLUT generated in step Sb6 (Sc7). In step Sc7, the γLUT is generated on the basis of the densities of the patch images of 16 tones for each color previously obtained in the patch detection control. For this reason, since the patch images do not need to be newly formed for generating the γLUT, down time of the calibration can be shortened. In addition, since the γLUT is generated on the basis of the measurement values of the patch images of 16 tones for each color, it is possible to correct the tone characteristics at a higher accuracy than a case where the γLUT is generated on the basis of measurement values of the patch images for 8 tones for each color. The MFP control unit 62 stores the updated γLUT in the memory unit 63 and ends the processing of the reader control.

Figure 1D:
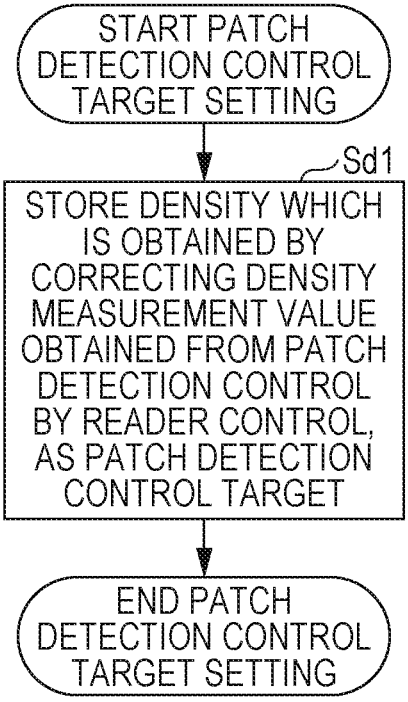

Next, the patch detection control target setting (Sa3) will be described with reference to FIG. 1D. In step Sc6, the MFP control unit 62 stores the density values converted from the output values of the photo sensor 160 stored in the memory 30 on the basis of the updated table 2 in the memory 30 as the reference densities (Sd1). The memory 30 stores the densities of 16 tones for each color as the reference densities. As a result, the target density data is updated. The MFP control unit 62 may be configured as a setting unit that sets the target density data and may be implemented by one or more circuits or as instructions encoded on a non-transitory recordable medium encoded with instructions executed by one or more processors.

Furthermore, the image forming apparatus 100 forms the patch images in a case where the predetermined condition is satisfied and updates the γLUT on the basis of the densities of the patch images detected by the photo sensor 160 and the reference densities obtained in step Sd1. In this case, the output gamma correction unit 82 converts the patch image data 16 on the basis of the γLUT obtained by the reader control (Sa2), and the printer B forms the patch images of 16 tones for each color on the photosensitive drum on the basis of the converted patch image data 16. The patch images are set to be the same as the patch images formed on the photosensitive drum in step Sc2. The CPU 28 controls the photo sensor 160 to detect the densities of the patch images. At this time, the density conversion circuit 42 converts the output values of the photo sensor 160 into the density on the basis of the conversion table updated in step Sc5. Subsequently, the printer control unit 109 updates the γLUT on the basis of the differences between the densities of the patch images and the reference densities stored in the memory 30 in step Sd1. Since the image forming processing of the image forming apparatus 100 is the same as the image forming processing illustrated in FIG. 9E, the descriptions thereof will be omitted.

Figure 14A:
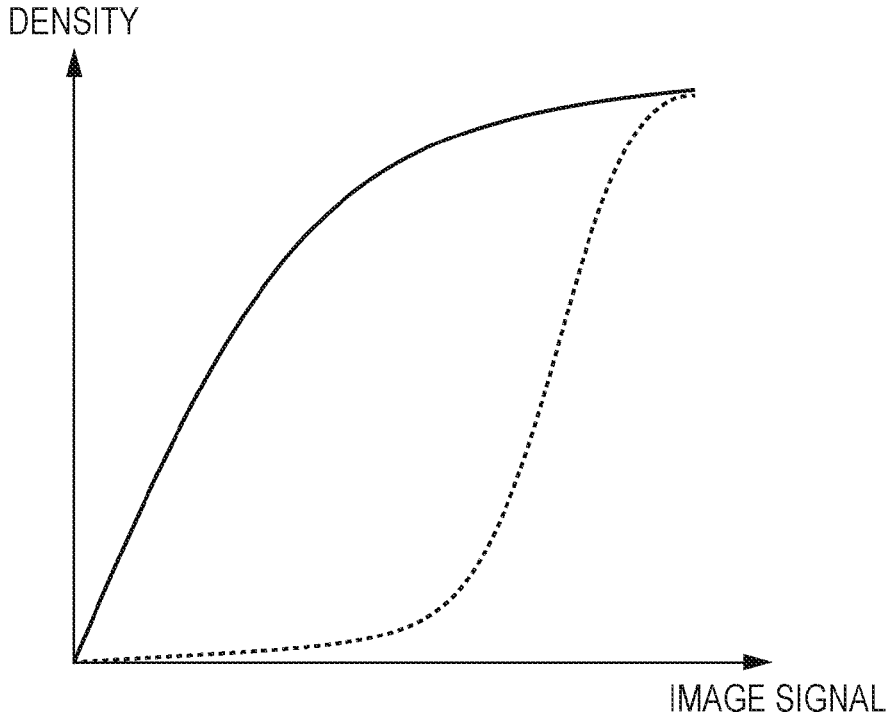
FIGS. 14A and 14B illustrate density characteristics of a patch image.

As described above, the MFP control unit 62 executes the patch detection control before the reader control to generate the γLUT. Since the output image processing unit 64 converts the patch image data on the basis of the γLUT generated in the above-described patch detection control, the densities of the patch images formed on the sheet on the basis of the converted patch image data converge to the target values. For this reason, the image forming apparatus 100 can reduce the number of the patch images formed on the sheet. FIG. 14A illustrates density characteristics of the patch image in a case where the reader control is executed without correcting the patch image data on the basis of the γLUT. The density characteristics (solid line) and the density characteristics (broken line) refer to the density characteristics of the patch images formed by the image forming apparatus 100 at the different quantities of states. As illustrated in FIG. 14A, in a case where the reader control is executed without correcting the patch image data on the basis of the γLUT, the densities of the patch images are varied by as much as 1.0.

With regard to the density characteristics (solid line) illustrated in FIG. 14A, the densities of the patch images are significantly increased in a range from the image signal at a low level to the image signal at a medium level (approximately ¾ of the image signal). On the other hand, with regard to the density characteristics (broken line) illustrated in FIG. 14A, the densities of the patch images are significantly increased in a range from the image signal at the medium level to the image signal at a high level (approximately ½ of the image signal). In this manner, in a case where the reader control is executed without correcting the patch image data on the basis of the γLUT, the density characteristics of the patch images are largely changed in accordance with the quantity of state of the image forming apparatus 100. For this reason, the patch images of the plurality of tones need to be formed on the sheet in the reader control in the related art.

Figure 14B:
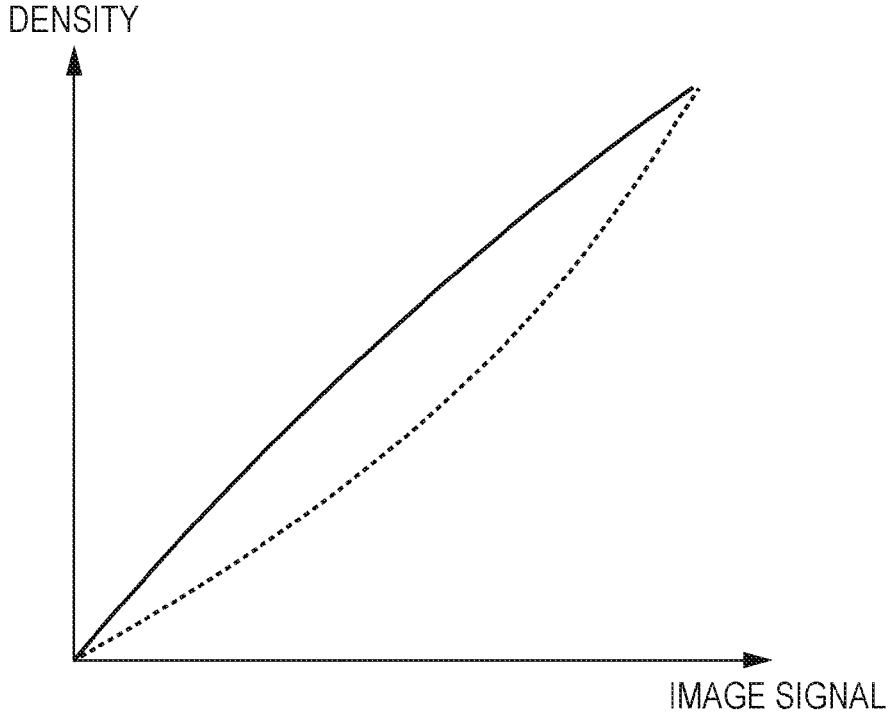

FIG. 14B illustrates the density characteristics of the patch images in a case where the reader control is executed by using the patch image data corrected on the basis of the γLUT. The density characteristics (solid line) and the density characteristics (broken line) refer to the density characteristics of the patch images formed by the image forming apparatus 100 in the different quantities of states. As illustrated in FIG. 14B, in a case where the reader control is executed by the patch image data corrected on the basis of the γLUT, the densities of the patch images are varied by up to 0.4. Since the reader control is executed by the patch image data corrected on the basis of the γLUT, abrupt changes do not appear in the density characteristics of the patch images. For this reason, even when the number of tones of the patch images formed on the sheet in the reader control according to the present exemplary embodiment is lower than the number of tones of the patch images formed on the sheet in the reader control in the related art, the reader control according to the present exemplary embodiment can maintain the accuracy equivalent to the reader control in the related art.

In a case where tone connection based on three types of screen processings (error diffusion, dither for a low number of lines, and dither for a high number of lines) is performed, the reader control in the related art needs the patch images of 64 tones for each color. The total number of the patch images formed by the four-color image forming apparatus becomes 768. For this reason, the number of the sheets used in the reader control in the related art is three sheets of the A4 size. However, the reader control according to the present exemplary embodiment can maintain the accuracy equivalent to the reader control in the related art by using the patch images of 8 tones for each color. In this case, the total number of the patch images formed by the four-color image forming apparatus is 96. For this reason, the number of the sheets used in the reader control according to the present exemplary embodiment is one sheet of the A4 size. It should be noted that the sizes of the patch images formed on the sheet in the reader control according to the present exemplary embodiment and the reader control in the related art are set to be the same. In addition, the number of sheets used in the reader control changes depending on the size of the patch images. For this reason, the number of sheets used in the reader control is an example and is not limited to this number.

According to the present exemplary embodiment, since the reader control is executed by using the patch image data corrected on the basis of the γLUT, it is possible to suppress the number of patch images formed on the sheet. For this reason, the number of sheets used in the reader control is lower than the number of sheets used in the reader control in the related art. In addition, after the conversion table for converting the densities into the output values of the photo sensor 160 is updated, the image forming apparatus 100 generates the γLUT by using the output values of the photo sensor 160 stored in the memory 30 without newly forming the patch images. For this reason, according to the present exemplary embodiment, it is possible to suppress the amount of developer consumed to generate the γLUT.

Modified Example

Hereinafter, a modified example will be described in which the tone correction control is executed by using color sensors 161 configured to measure a density of the measuring image fixed onto the sheet. It should be noted that elements that are not particularly mentioned are the same as those according to the first exemplary embodiment. The color sensors 161 may be configured as a measurement unit configured to measure images on a sheet or other surface.

As illustrated in FIG. 3, the color sensors 161 are arranged in downstream of the fixing unit 114 in a direction in which the sheet is conveyed (hereinafter, which will be referred to as a conveyance direction). Two of the color sensors 161 are arranged so as to be next to each other in a direction perpendicular to the conveyance direction in which the sheet is conveyed. According to the image forming apparatus 100 provided with the color sensors 161, the user does not need to perform an operation of controlling the reader A to read the sheet on which the patch images are formed. For this reason, even when the user does not directly activate the tone correction control, the image forming apparatus 100 can execute the tone correction control at a predetermined timing. In addition, an advantage is attained that the image forming apparatus that is not provided with the reader A can also implement the tone correction control.

Hereinafter, the tone correction control in the modified example will be described with reference to FIGS. 15A to 15D.

Figure 15A:
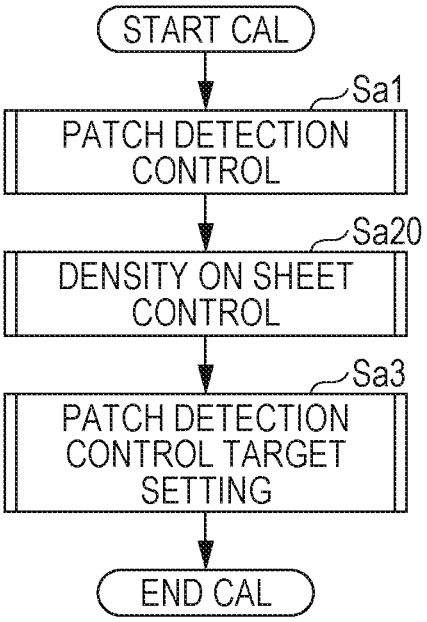
FIGS. 15A to 15D are flow charts illustrating a modified example of the tone correction control.
Figure 15B:
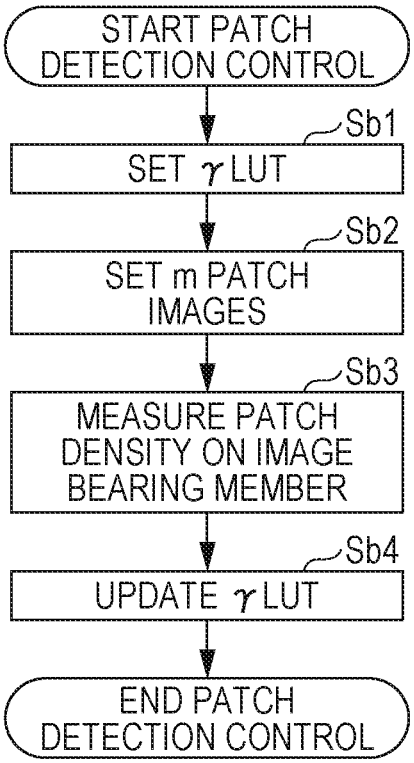
Figure 15C:
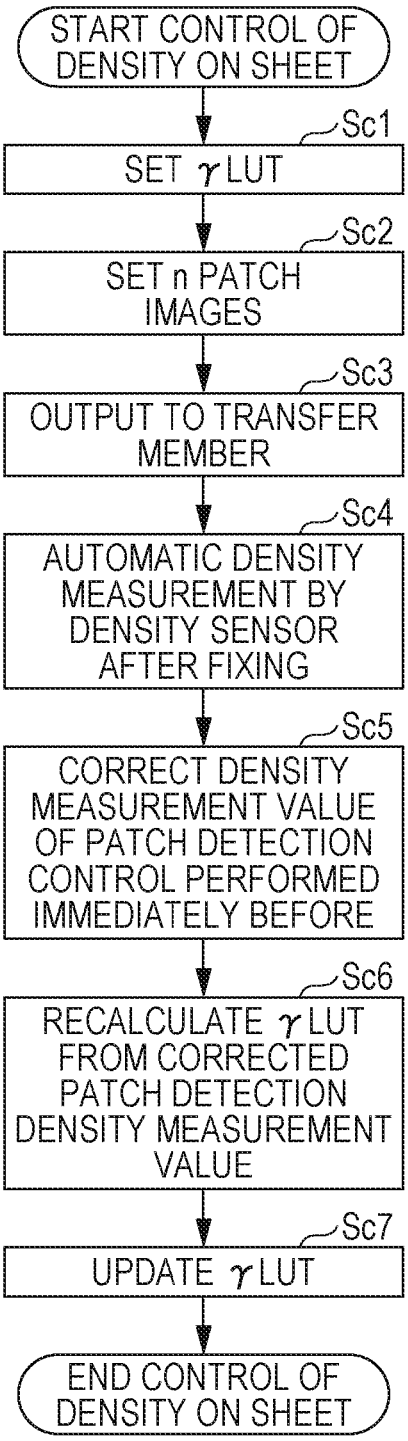
Figure 15D:
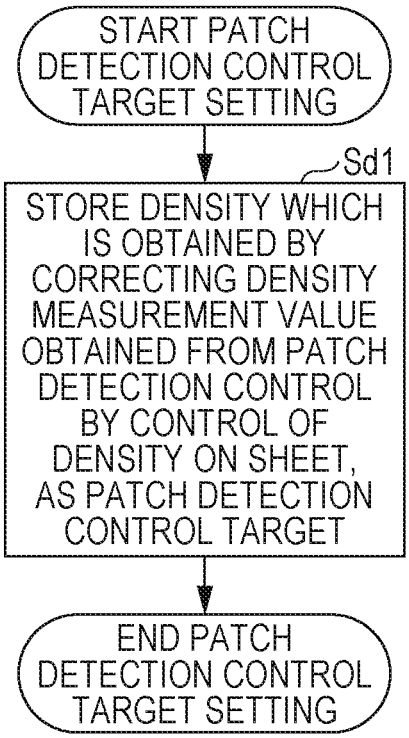
Figure 16:
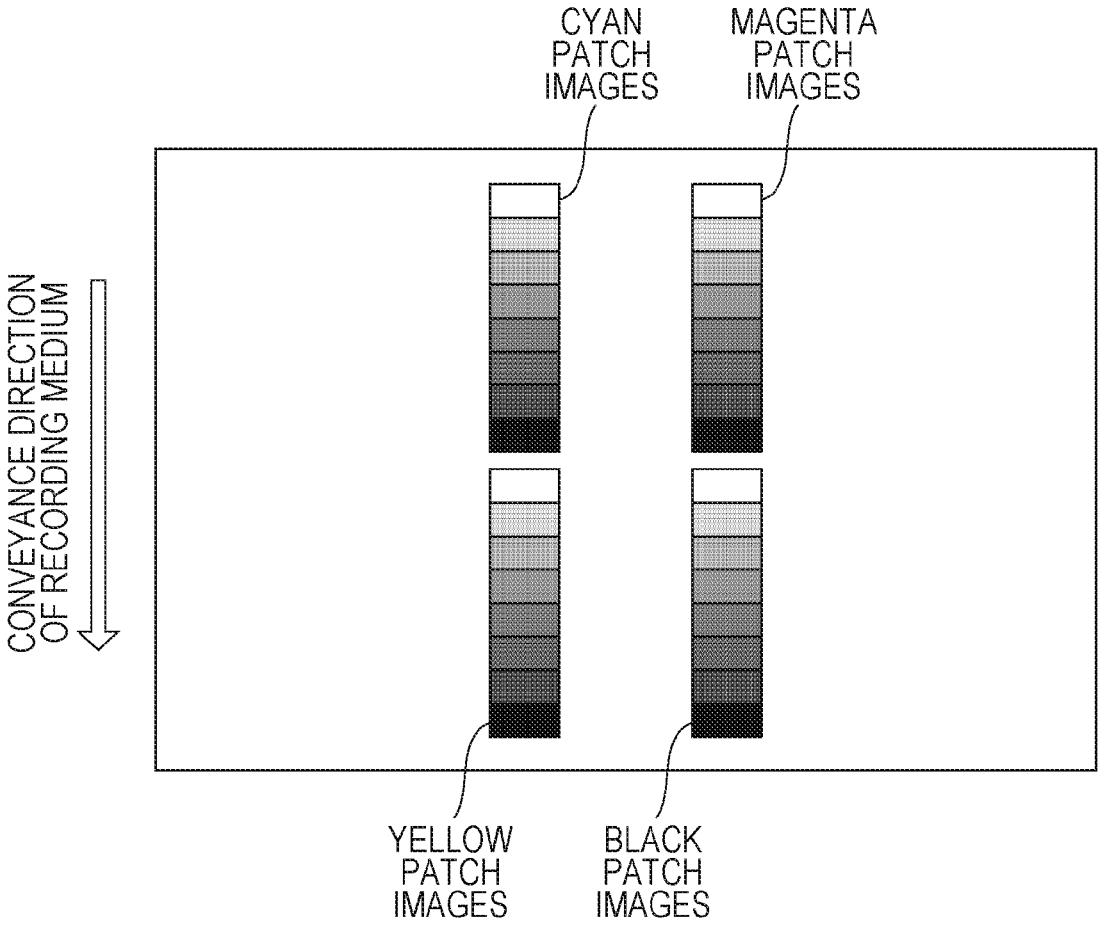
FIG. 16 is a schematic diagram of the patch image formed on the sheet.

As illustrated in FIG. 15A, the tone correction control includes the patch detection control (Sa1), density control on the sheet (Sa20), and the target setting (Sa3). Since the patch detection control (Sa1) is the same as that of the first exemplary embodiment, descriptions of the patch detection control will be omitted. The density control on the sheet (Sa20) measures the patch images by using the color sensor 161 instead of the reader A. The respective processings of the density control on the sheet are similar to those of the first exemplary embodiment except that the color sensor 161 is used instead of the reader A. While the sheet is conveyed, the color sensor 161 measures the densities of the patch images on the sheet. FIG. 16 is a schematic diagram of the patch image formed on the sheet. The patch images of 8 tones are fixed onto the sheet for each color. It should be noted that the size of the sheet is A4.

Figure 17:
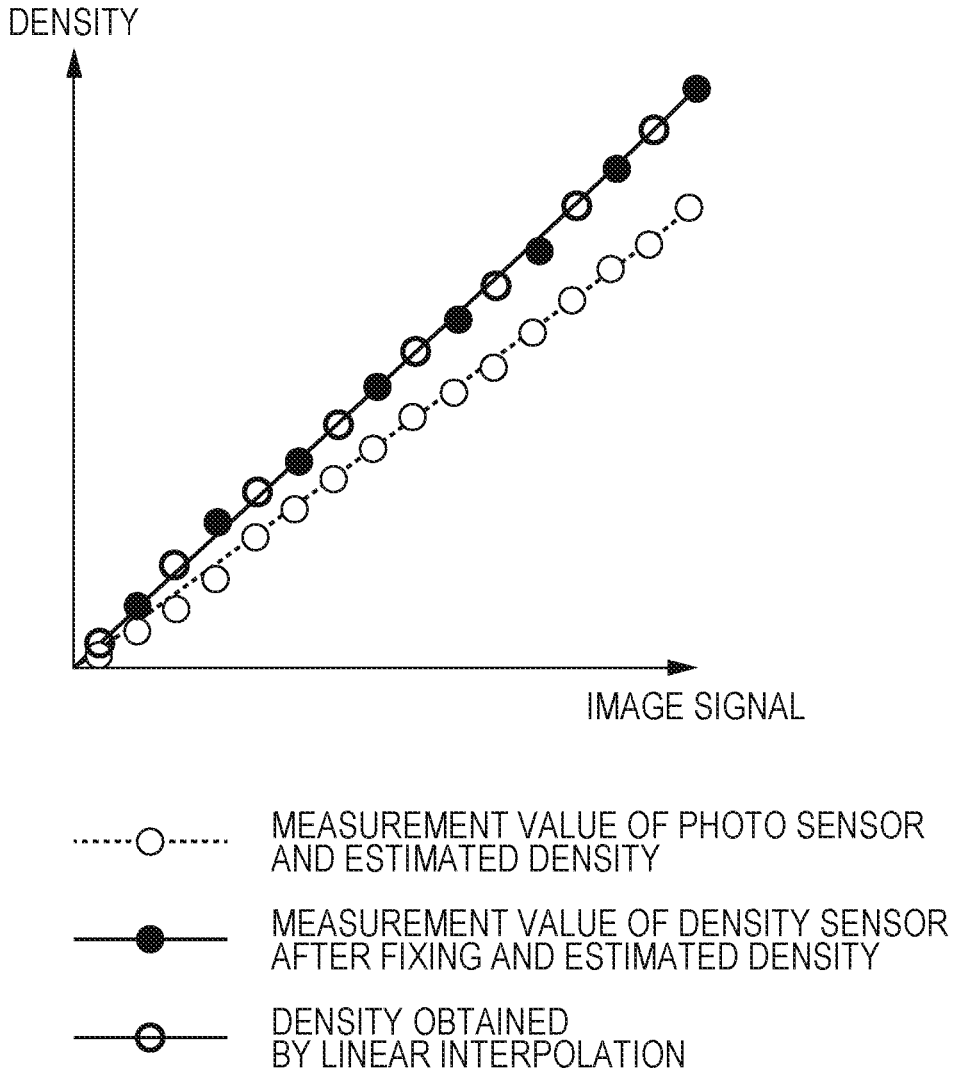
FIG. 17 illustrates density characteristics of the patch image according to a modified example.

The patch detection control target setting (Sa3) is the same as that of the first exemplary embodiment. It should be noted that, in a case where the conversion table is updated, as illustrated in FIG. 17, missing measurement results of the patch images are obtained by performing the linear interpolation from the measurement result of the actually measured patch images. In a case where the patch images are formed on the sheet without correcting the patch image data, the number of the patch images used in the tone correction control is the same as the number of the patch images in the reader control in the related art.

According to the present modified example, since the density control on the sheet is executed by using the patch image data corrected on the basis of the γLUT, it is possible to suppress the number of patch images formed on the sheet. For this reason, it is possible to reduce the number of sheets used in the density control on the sheet. After the conversion table for converting the densities into the output values of the photo sensor 160 is updated, the image forming apparatus 100 the γLUT corrects by using the output values of the photo sensor 160 stored in the memory 30 without newly forming the patch images. For this reason, according to the present modified example, it is possible to suppress the amount of developer consumed to generate the γLUT. Furthermore, the image forming apparatus 100 according to the present modified example includes the color sensors 161 in a conveyance path where the sheet is conveyed. The patch images formed on the sheet are measured by the color sensor 161, and the γLUT is generated on the basis of the measurement results. For this reason, it is possible to automatically execute the tone correction control by the image forming apparatus according to the present modified example, and it is possible to improve usability more than the configuration in which the patch images on the sheet are measured by using the reader A.

Second Exemplary Embodiment

The image forming apparatus 100 described according to the first exemplary embodiment measures the patch images on the photosensitive drum 121 by using the photo sensor 160. However, the image forming apparatus may adopt a configuration in which the patch images are formed on the intermediate transfer member to which the image is transferred, and the patch images on the intermediate transfer member are measured. Hereinafter, an image forming apparatus 200 provided with an intermediate transfer belt 210 functioning as the intermediate transfer member, a photo sensor 50 configured to measure a first measuring image on the intermediate transfer belt, and a color sensor 80 configured to measure a second measuring image formed on the sheet will be described.

Figure 18:
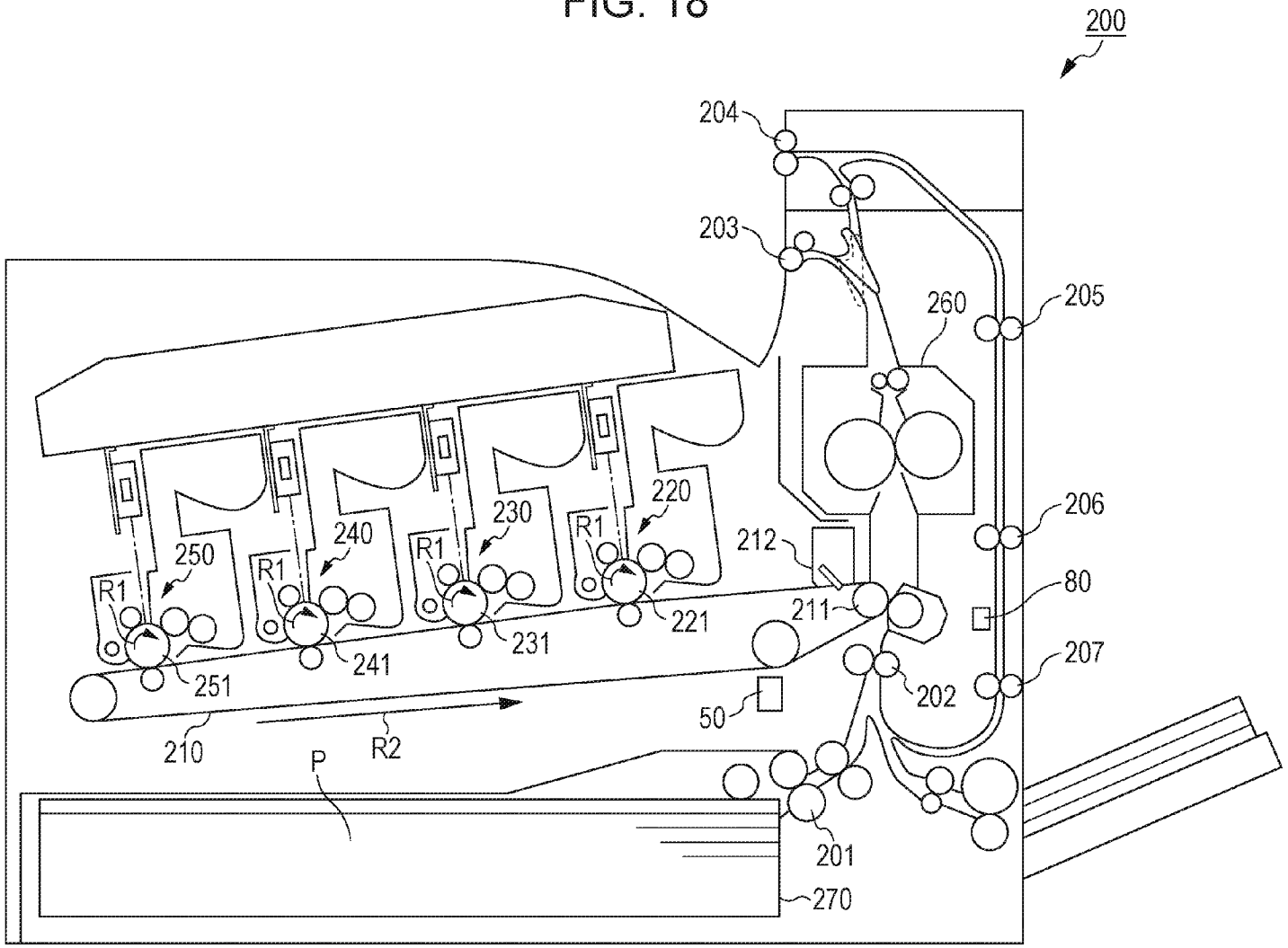
FIG. 18 is a schematic cross sectional view of another image forming apparatus.

FIG. 18 is a schematic cross sectional view of the image forming apparatus 200. An image forming unit 220 forms a yellow image, an image forming unit 230 forms a magenta image, an image forming unit 240 forms a cyan image, and an image forming unit 250 forms a black image. The image forming unit 220 includes a photosensitive drum 221. The image forming units 230, 240, and 250 also include photosensitive drums 231, 241, and 251 similarly as in the image forming unit 220. The photosensitive drums 221, 231, 241, and 251 rotate in a direction of an arrow R1.

The image forming apparatus 200 is further provided with the intermediate transfer belt 210 to which the images formed by the image forming units 220, 230, 240, and 250 are transferred. The intermediate transfer belt 210 is hung around a plurality of rollers. The intermediate transfer belt 210 rotates in a direction of an arrow R2 by rotation of driving rollers. The images of the colors respectively formed on the image forming units 220, 230, 240, and 250 are transferred to the intermediate transfer belt 210 so as to be overlapped with one another. As a result, a full-color image is transferred to the intermediate transfer belt 210. Furthermore, the intermediate transfer belt 210 is provided with transfer rollers 211 to which a transfer voltage is applied. The transfer rollers 211 transfer the image on the intermediate transfer belt 210 to a sheet P.

The image forming apparatus 200 is provided with a cassette 270 containing the sheets P. The sheets P contained in the cassette 270 are fed by pick-up rollers 201 and conveyed towards registration rollers 202. The registration rollers 202 controls a conveyance speed of the sheet or a conveyance timing such that the image on the intermediate transfer belt 210 is transferred at a desired position of the sheet.

The sheet P to which the image is transferred by the transfer rollers 211 is conveyed to a fixing device 260. The fixing device 260 fixes the image onto the sheet P by heat of a heater which is not illustrated in the drawing and pressure of the roller pair. The sheet P on which the image is fixed is discharged from the image forming apparatus 200 by discharging rollers 203.

The image forming apparatus 200 is provided with the photo sensor 50 configured to measure the patch images formed by the intermediate transfer belt 210. The photo sensor 50 is provided with a light emitting element configured to emit light to the intermediate transfer belt 210 and a light receiving element configured to receive reflected light from the intermediate transfer belt 210. The light receiving element outputs a signal based on the received light amount (received light intensity) of the reflected light. The photo sensor 50 measures the patch images on the intermediate transfer belt 210 in patch detection controls A and B which will be described below.

Furthermore, the image forming apparatus 200 is provided with the color sensor 80 configured to measure a pattern image on the sheet. The color sensor 80 functions as a measurement unit configured to measure the pattern image fixed onto the sheet. In a case where the color sensor 80 measures the pattern image, the sheet P onto which the pattern images are fixed is conveyed to reversing rollers 204. The reversing rollers 204 switches back the sheet P. The sheet P after the conveyance direction is switched by the reversing rollers 204 is conveyed towards rollers 205. The rollers 205, conveyance rollers 206, and conveyance rollers 207 convey the sheet P. A measurement position of the color sensor 80 is located between the conveyance rollers 206 and the conveyance rollers 207. While the sheet P is conveyed by the conveyance rollers 206, the color sensor 80 measures the pattern image on the sheet. The color sensor 80 measures the pattern image on the sheet by color sensor control which will be described below.

The sheet P conveyed by the conveyance rollers 207 is conveyed to the registration rollers 202. As a result, the sheet P where the measuring image is measured passes through the fixing device 260 again and is discharged from the image forming apparatus 200 by the discharging rollers 203.

Figure 19A:
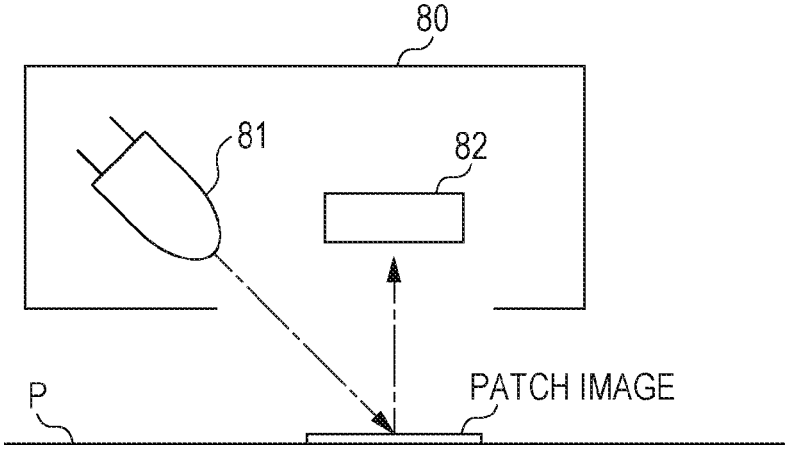
FIG. 19A is a main part cross sectional view of a color sensor.
Figure 19B:
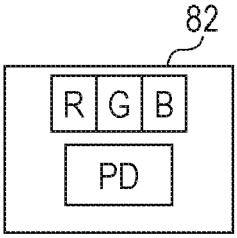
FIG. 19B is a schematic configuration diagram of a light receiving element of the color sensor.

FIG. 19A is a main part cross sectional view of the color sensor 80. FIG. 19B is a schematic configuration diagram of the light receiving element of the color sensor 80. The color sensor 80 is provided with a white light emitting diode (LED) 81 and a charge-storage-type sensor 82 including an RGB on-chip filter. The white LED 81 functions as the light emitting element, and the charge-storage-type sensor 82 functions as the light receiving element. The color sensor 80 reads the patch images fixed onto the sheet P and output luminance signals of red (R), green (G), and blue (B).

In the color sensor 80, the light emitted from the white LED 81 obliquely enters the sheet P on which the patch images are formed after the fixing at 45 degrees, and diffused reflection light towards a 0-degree direction is detected by the charge-storage-type sensor 82. As illustrated in FIG. 19B, pixels of red (R), green (G), and blue (B) are independent from one another in the charge-storage-type sensor 82.

The charge-storage-type sensor 82 may be, for example, a photodiode. In addition, the charge-storage-type sensor 82 may be a line sensor in which a several sets of pixels of red (R), green (G), and blue (B) are aligned. Moreover, the color sensor 80 may adopt a configuration in which the light emitting element and the light receiving element are arranged such that an incoming angle is set as 0 degrees, and a reflection angle is set as 45 degrees. Furthermore, the color sensor 80 may adopt a configuration provided with LEDs and photodiodes configured to emit lights of red, green, and blue.

Figure 20:
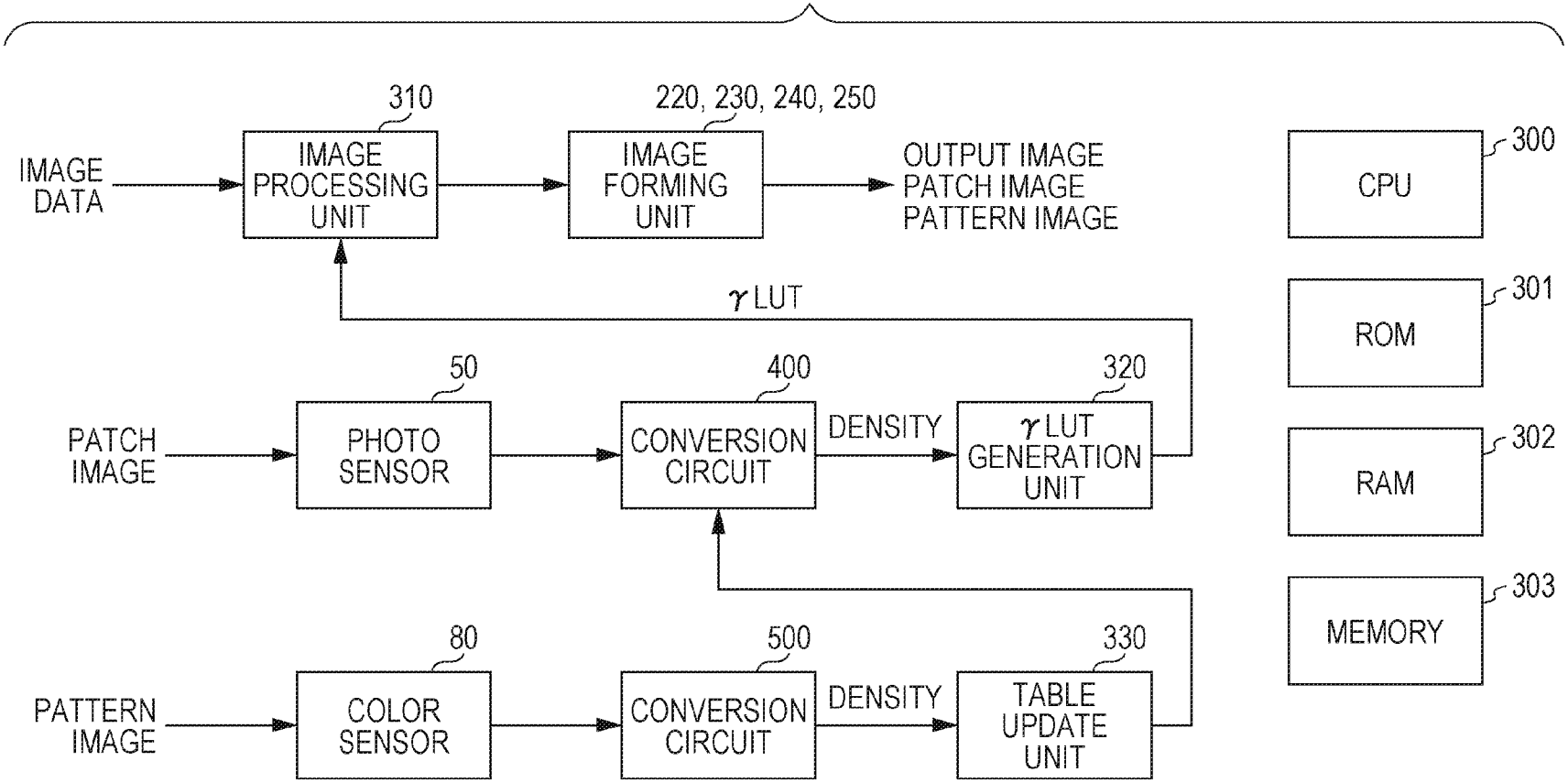
FIG. 20 is a control block diagram of the other image forming apparatus.

FIG. 20 is a control block diagram of the image forming apparatus 200. A CPU 300 is a control circuit configured to control respective units of the image forming apparatus 200. A ROM 301 stores the control program used to execute various processing of a flow chart which will be described below to be executed by the CPU 300. A RAM 302 is a system work memory for the CPU 300 to operate. A memory 303 is a non-volatile memory. The memory 303 stores the look-up table which will be described below, output values of the patch images by the photo sensor 50, and the densities of the patch images. The memory 303 may be configured as a storage unit. It should be noted that, since the image forming unit 220 (230, 240, and 250), the photo sensor 50, and the color sensor 80 have been already described, the descriptions thereof will be omitted here. In addition, the image data is transferred, for example, from a printing server or a scanner connected to the image forming apparatus 200.

An image processing unit 310 applies various image processing to the image data to convert the image data. The densities of the images formed by the image forming unit 220 do not become desired densities. In view of the above, the image processing unit 310 corrects the input value (image signal value) of the image data on the basis of the look-up table (γLUT) stored in the memory 303 such that the density of the image formed by the image forming unit 220 becomes the desired density. The look-up table (γLUT) is equivalent to the correction condition for correcting the image data. It should be noted that the image processing unit 310 may be realized by an integrated circuit such as ASIC or may be realized by converting the image data on the basis of a program previously stored and executed by the CPU 300.

A conversion circuit 400 converts the output value of the photo sensor 50 into the density on the basis of the conversion table. The conversion circuit 400 converts an analog output value of the photo sensor 50 into a digital signal and determines the density from the digital signal on the basis of the conversion table stored in the memory 303. The conversion circuit 400 obtains the value of the density for each of the patch images to be output to a γLUT generation unit 320. The conversion table is equivalent to the conversion condition for converting the measurement results of the patch images. In addition, the conversion table is not limited to the data indicating the correspondence relationship between the output values and the densities. The conversion circuit 400 may be, for example, a calculation circuit configured to output the value of the density on the basis of the output value by using a calculation expression. In this case, the calculation expression is equivalent to the conversion condition.

The γLUT generation unit 320 generates the γLUT on the basis of the reference densities and the densities of the patch images stored in the memory 303. Since the generation method for the γLUT is similar to that of the first exemplary embodiment, the description thereof will be omitted here.

A conversion circuit 500 converts the output value of the color sensor into the density. The conversion circuit 500 detects the densities of the pattern images by using a relationship between complementary colors, for example. The conversion circuit 500 determines the density on the basis of a condition different from that of the conversion circuit 400. The conversion circuit 500 obtains the value of the density for each pattern image to be output to a table update unit 330. The conversion circuits 400 and 500 may be configured as multiple conversion units or as a single integrated conversion unit to convert measurement results of measurement images. The conversion circuits 400 and 500 may be implemented as a set of circuits, or as one or more processors (CPU) which implement instructions encoded on a non-transitory computer readable medium. The conversion unit may also include other circuits and/or instructions described above and below which are used in addition to or instead of the conversion circuits 400 and 500 which are configured to convert measurement results.

The table update unit 330 updates the conversion table used by the conversion circuit 400. The same method as the method described according to the first exemplary embodiment is used as a method for the table update unit 330 to update the conversion table.

Next, the tone correction control executed by the image forming apparatus 200 will be described with reference to FIGS. 21A to 21E. When the command for instructing the execution of the tone correction control is received from an operation unit which is not illustrated in the drawing, the CPU 300 executes the control program of the tone correction control stored in the ROM 301.

First, the CPU 300 executes the patch detection control A (S100). Respective steps in step S100 will be described with reference to a flow chart of FIG. 21B. The CPU 300 controls the image forming units 220, 230, 240, and 250 to form the patch images of 16 tones for each color (S101). In step S101, the CPU 300 sets the latest γLUT stored in the memory 303 in the image processing unit 310 and outputs the patch image data stored in the ROM 301 to the image processing unit 310. The image processing unit 310 corrects the patch image data on the basis of the γLUT to be transferred to the image forming units 220, 230, 240, and 250. The image forming units 220, 230, 240, and 250 form the patch images on the basis of the corrected patch image data.

The patch images are transferred from the photosensitive drums 221, 231, 241, and 251 to the intermediate transfer belt 210 and conveyed towards the photo sensor 50. The CPU 300 measures the patch images by the photo sensor 50 at a timing when the patch images passes through the measurement position of the photo sensor 50 (S102). The output values of the photo sensor 50 are converted into the densities by the conversion circuit 400 and input to the γLUT generation unit 320. It should be noted that the conversion circuit 400 converts the output values into the densities on the basis of the conversion table stored in the memory 303. Furthermore, the output values from the photo sensor 50 and the densities of the patch images converted by the conversion circuit 400 are saved in the memory 303.

Subsequently, the CPU 300 controls the γLUT generation unit 320 to generate the γLUT on the basis of the densities of the patch images (S103). The γ generation unit 320 generates the γLUT_A such that the difference between the densities of the patch images and the reference densities stored in the memory 303 is suppressed. The CPU 300 stores the γLUT_A in the memory 303.

Figure 21A:
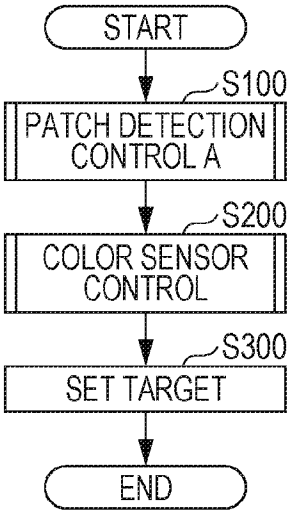
FIGS. 21A to 21E are flow charts illustrating another tone correction control.
Figure 21B:
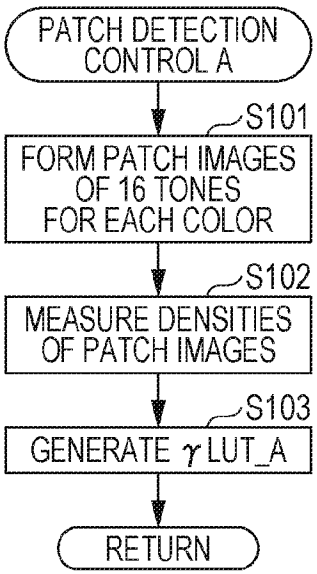
Figure 21C:
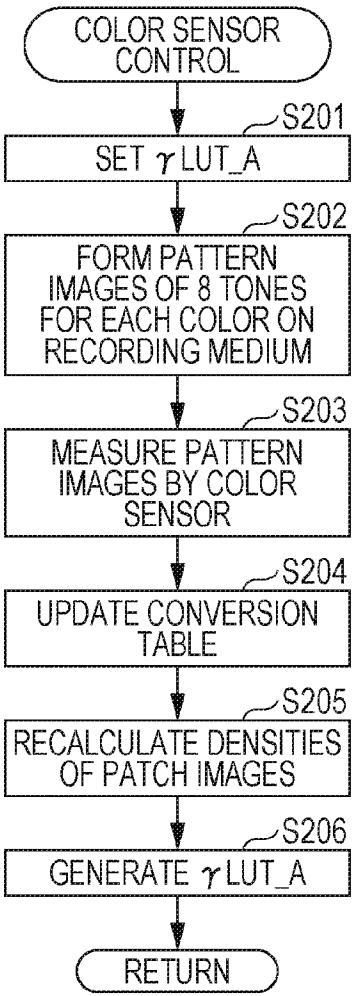

When the patch detection control A is completed, as illustrated in FIG. 21A, the CPU 300 executes the processing of the color sensor control (S200). Respective processings in step S200 will be described with reference to a flow chart of FIG. 21C.

The CPU 300 sets the γLUT_A stored in the memory 303 in the image processing unit 310 (S201) and outputs the pattern image data stored in the ROM 301 to the image processing unit 310. The image processing unit 310 corrects the pattern image data on the basis of the γLUT_A. Subsequently, the CPU 300 controls the image forming units 220, 230, 240, and 250 to form the pattern images of eight tones for each color on the sheet P (S202). In step S202, the image forming units 220, 230, 240, and 250 form the pattern images on the sheet P on the basis of the corrected pattern image data.

Subsequently, the CPU 300 conveys the sheet P on which the pattern images are formed towards the color sensor 80. The CPU 300 controls the color sensor 80 to measure the pattern images at a timing when the sheet P onto which the pattern images are fixed passes through the measurement position of the color sensor 80 (S203). The output value of the color sensor 80 is converted into the density by the conversion circuit 500. Subsequently, the table update unit 330 updates the conversion table on the basis of the densities of the patch images stored in the memory 303 in step S102 and the densities of the pattern images detected in step S202 (S204). The method of updating the conversion table in step S204 has been already described in the explanation of the first exemplary embodiment. For this reason, the descriptions of the update method for the conversion table will be omitted here. One or both of the table update unit 330 and the γLUT generation unit 320 may be configured as part or all of a determination unit. The table update unit 330 and the γLUT generation unit 320 may be implemented as one or more dedicated circuits or may be implemented as instructions encoded on a computer readable medium executed by one or more processors (CPU).

After the conversion table is updated, the CPU 300 recalculates the densities of the patch images formed in step S101 on the intermediate transfer belt 210 (S205). In step S205, the CPU 300 sets the updated conversion table in the conversion circuit 400 and controls the conversion circuit 400 to convert the output values of the photo sensor 50 to obtain the densities of the patch images again. It should be noted that the output values of the photo sensor 50 corresponding to the measurement results of the patch images are previously stored in the memory 303. As a result, the CPU 300 obtains the densities of the patch images of 16 tones for each color.

After the densities of the patch images are obtained in step S205, the CPU 300 controls the γLUT generation unit 320 to generate the γLUT_A on the basis of the densities obtained again (S206). The γLUT generation unit 320 generates the γLUT_A on the basis of the conversion results of the output values based on the conversion table. In step S206, the γLUT generation unit 320 generates the γLUT_A on the basis of the density target stored in the ROM 301 and the densities obtained in step S205. The CPU 300 stores the γLUT_A generated in step S206 in the memory 303 and ends the processing of the color sensor control.

When the color sensor control is completed, as illustrated in FIG. 21A, the CPU 300 executes the processing of the target setting (S300). In step S300, the CPU 300 stores the density values of the patch images obtained in step S205 in the memory 303 as the reference densities. The memory 303 stores the densities of 16 tones for each color as the reference densities. Subsequently, the CPU 300 ends the processing of the tone correction control. It should be noted that the reference densities stored in the memory 303 are used in the patch detection control B which will be described below. The CPU 300 may be configured as a setting unit that executes the process of setting the target density data.

Figure 21D:
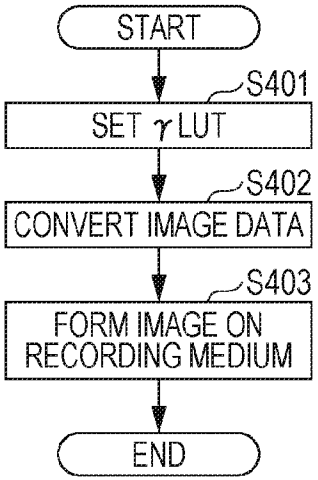
Figure 21E:
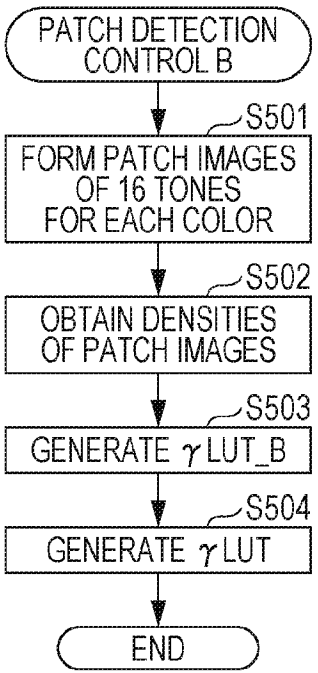

FIG. 21E is a flow chart illustrating the patch detection control B. When a predetermined condition is satisfied, the CPU 300 executes the control program of the patch detection control B which is stored in the ROM 301.

First, the CPU 300 controls the image forming units 220, 230, 240, and 250 to form the patch images of 16 tones for each color (S501). In step S501, the CPU 300 sets the latest γLUT stored in the memory 303 in the image processing unit 310 and outputs the patch image data stored in the ROM 301 to the image processing unit 310. The image processing unit 310 corrects the patch image data on the basis of the γLUT to be transferred to the image forming units 220, 230, 240, and 250. The image forming units 220, 230, 240, and 250 forms the patch images on the basis of the corrected patch image data. It should be noted that the patch image data used in step S501 is the same as the patch image data used in step S101 described above.

The patch images are transferred from the photosensitive drums 221, 231, 241, and 251 to the intermediate transfer belt 210 and conveyed towards the photo sensor 50. The CPU 300 measures the patch images by the photo sensor 50 at a timing when the patch images passes through the measurement position of the photo sensor 50 (S502). The output values of the photo sensor 50 are converted into the densities by the conversion circuit 400 and input to the γLUT generation unit 320. It should be noted that the conversion circuit 400 converts the output values into the densities on the basis of the conversion table updated in step S204. In the conversion table updated in step S204 is stored in the memory 303.

Subsequently, the CPU 300 controls the γLUT generation unit 320 to generate the γLUT_B on the basis of the densities of the patch images (S503). The γLUT generation unit 320 generates the γLUT_B on the basis of the densities of the patch images and the reference densities stored in the memory 303. The γLUT generation unit 320 may obtain the tone characteristics on the basis of the densities of the patch images, for example, identify the image signal with which the tone characteristics become the ideal tone characteristics, and determine the γLUT_B such that the input values are converted into the output values so as to have the ideal tone characteristics.

Subsequently, the CPU 300 controls the γLUT generation unit 320 to combine the γLUT_A and the γLUT_B with each other to generate the γLUT (S504). The method of generating the γLUT in step S504 is similar to the method according to the first exemplary embodiment. Subsequently, the CPU 300 stores the γLUT generated in step S504 in the memory 303 and ends the processing of the patch detection control B.

FIG. 21D is a flow chart illustrating the image forming processing of the image forming apparatus 100. When the image data is transferred from the scanner or the printing server, the CPU 300 sets the latest γLUT stored in the memory 303 in the image processing unit 310 (S401). In step S401, the latest γLUT immediately after the color sensor control is executed is the γLUT_A, and the latest γLUT after the patch detection control B is executed is the combined γLUT.

Subsequently, the CPU 300 controls the image processing unit 310 to correct the image data on the basis of the γLUT (S402) and controls the image forming units 220, 230, 240, and 250 to form the images on the basis of the image data (S403), and the image forming processing is ended.

According to the present exemplary embodiment, since the pattern images are formed on the sheet by using the pattern image data corrected on the basis of the γLUT, the number of pattern images formed on the sheet can be set to be lower than the number of the patch images. As a result, the number of sheets used in the color sensor control can be reduced. After the conversion table for converting the output values of the photo sensor 50 into the densities is updated, the image forming apparatus 200 generates the γLUT by using the output values of the photo sensor 50 stored in the memory 303 without newly forming the patch images. For this reason, according to the present exemplary embodiment, it is possible to suppress the amount of developer consumed to generate the γLUT. Furthermore, the image forming apparatus 200 includes the color sensor 80 in the conveyance path where the sheet is conveyed, measures the pattern images formed on the sheet by the color sensor 80, and generates the γLUT on the basis of the measurement results. For this reason, the image forming apparatus 200 can automatically execute the tone correction control, and it is possible to further improve the usability as compared with the configuration in which the patch images on the sheet are measured by using the reader A.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-087597 filed Apr. 26, 2016 and No. 2017-022467 filed Feb. 9, 2017, which are hereby incorporated by reference herein in their entirety.

What is claimed is:

1. An image forming apparatus comprising:

an image forming unit configured to form an image on a sheet;

an intermediate transfer member to which a measuring image formed by the image forming unit is transferred;

a measurement unit configured to measure the measuring image on the intermediate transfer member;

a conversion unit configured to convert a measurement result of the measuring image on a basis of a conversion condition;

a determination unit configured to determine an image forming condition on a basis of the measurement result converted by the conversion unit; and an update unit configured to control the image forming unit to form first measuring images, control the measurement unit to measure the first measuring images, control the conversion unit to convert the measurement results of the first measuring images, control the determination unit to determine a measuring image forming condition on a basis of the converted measurement results of the first measuring images, control the image forming unit to form second measuring images on the sheet on a basis of the measuring image forming condition, obtain measuring results of the second measuring images output from another measuring unit different from the measurement unit, and update the conversion condition on a basis of the measurement results of the second measuring images, wherein a number of the second measuring images is lower than a number of the first measuring images.

2. The image forming apparatus according to claim 1, wherein, after the update unit updates the conversion condition, the determination unit controls the conversion unit to convert the measurement results of the first measuring images on a basis of the updated conversion condition and determines the image forming condition on a basis of the conversion result.

3. The image forming apparatus according to claim 2, further comprising:

a storage unit configured to store the measurement results of the first measuring images.

4. The image forming apparatus according to claim 1, wherein the conversion unit converts the measurement results of the measuring images into density data on a basis of the conversion condition.

5. The image forming apparatus according to claim 4, further comprising:

a setting unit configured to perform a setting in target density data, wherein the determination unit determines the image forming condition on a basis of the density data and the target density data, and wherein the setting unit updates the target density data in a case where the update unit updates the conversion condition.

6. The image forming apparatus according to claim 1, wherein the image forming condition is a tone correction condition for correcting tone characteristics of the image is to be formed by the image forming unit.

7. The image forming apparatus according to claim 6, further comprising:

a correction unit configured to correct the image data on a basis of the tone correction condition, wherein the image forming unit forms an output image on a basis of the image data corrected by the correction unit.

8. The image forming apparatus according to claim 1, wherein the first measuring images include a plurality of measuring images having different densities, wherein the second measuring images include a plurality of measuring images having different densities, and wherein a number of the densities of the second measuring images is lower than a number of the densities of the first measuring images.

9. A control method for an image forming apparatus including an image forming unit that forms an image on an image bearing member, a transfer portion which the image is transferred from the image bearing member onto a sheet, and a measurement unit that measures a measuring image formed on the image bearing member, the control method comprising:

forming measuring images on the image bearing member;

measuring the measuring images by the measurement unit;

converting from measurement results of the measuring images to first data based on a conversion condition;

generating a first correction condition based on the first data;

correcting pattern image data based on the first correction condition;

forming pattern images on the sheet based on the corrected pattern image data;

obtaining output data related to the pattern images formed on the sheet, wherein the output data is output from a sensing device;

determining the conversion condition based on the output data;

converting from the measurement results of the measuring images to second data based on the determined conversion condition; and generating second correction condition based on the second data, wherein a number of pattern images is less than a number of measuring images, wherein, in a case where an output image is formed on the sheet based on image data, the image data is corrected based on the second correction condition.

10. The control method according to claim 9, wherein a number of tones of the pattern images is less than a number of tones of the measuring images.

11. The control method according to claim 9, further comprising:

forming other measuring images on the image bearing member;

measuring the other measuring images by the measurement unit;

converting measurement results of the other measuring based on the determined conversion condition; and adjusting the second correction condition based on the converted other measuring images, wherein a number of tones of the other measuring images is less than a number of tones of the measuring images.

12. The control method according to claim 11, wherein a number of tones of the pattern images is less than a number of tones of the measuring images.

13. The control method according to claim 11, further comprising;

correcting measuring image data based on the second correction condition, wherein the other measuring images are formed based on the corrected measuring image data.

14. The control method according to claim 9, further comprising:

storing the measurement results of the measuring images, wherein the second data is converted from the stored measurement results based on the determined conversion condition.

15. The control method according to claim 9, further comprising:

fixing the pattern images on the sheet, wherein the output data corresponds to sensing results of the pattern images fixed on the sheet.

16. The control method according to claim 9, wherein the image bearing member is photosensitive member.

17. The control method according to claim 9, wherein the image bearing member is an intermediate transfer member different form a photosensitive member of the image forming unit.

18. The control method according to claim 9, wherein the measuring images are measuring images having a first color and measuring images having a second color different from the first color, wherein the pattern images are pattern images having the first color and pattern images having the second color.

* * * * *